US012203689B2

(12) United States Patent
Olvera

(10) Patent No.: US 12,203,689 B2
(45) Date of Patent: Jan. 21, 2025

(54) REVOLVING ICE MAKER

(71) Applicant: Electrolux Home Products, Inc., Charlotte, NC (US)

(72) Inventor: Jose Carlos Trejo Olvera, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 18/104,973

(22) Filed: Feb. 2, 2023

(65) Prior Publication Data

US 2023/0175752 A1 Jun. 8, 2023

Related U.S. Application Data

(63) Continuation of application No. 16/841,015, filed on Apr. 6, 2020, now Pat. No. 11,598,566.

(51) Int. Cl.

| | |
|---|---|
| ***F25C 1/10*** | (2006.01) |
| ***F25C 1/24*** | (2018.01) |
| ***F25C 5/04*** | (2006.01) |
| ***F25C 5/20*** | (2018.01) |

(52) U.S. Cl.

CPC ..... *F25C 1/10* (2013.01); *F25C 1/24* (2013.01); *F25C 5/04* (2013.01); *F25C 5/22* (2018.01); *F25C 2305/022* (2013.01)

(58) Field of Classification Search

CPC ..... F25C 1/10; F25C 2305/022; F25C 5/22; F25C 5/04; F25C 1/24

See application file for complete search history.

(56) References Cited

U.S. PATENT DOCUMENTS

| | | | |
|---|---|---|---|
| 2,403,406 | A | 9/1944 | Smith |
| 2,846,854 | A | 8/1958 | Galin |
| 2,941,379 | A | 6/1960 | Nelson |

(Continued)

FOREIGN PATENT DOCUMENTS

| | | |
|---|---|---|
| CN | 101922832 | 5/2012 |
| JP | H087015 | 5/1992 |

(Continued)

OTHER PUBLICATIONS

Translated_Hideaki (Year: 2011).*

(Continued)

*Primary Examiner* — Elizabeth J Martin
*Assistant Examiner* — Samba Gaye
(74) *Attorney, Agent, or Firm* — Chrisman Gallo Tochtrop LLC

(57) ABSTRACT

An ice maker for freezing water into ice pieces, the ice maker including an elongated cage having a central revolving axis about which the elongated cage revolves. The elongated cage having a first end, a second end and at least one elongated slot extending between the first end and the second end. An ice tray is configured to be received in the at least one elongated slot. The ice tray includes a plurality of cavities for receiving water to be frozen into ice pieces. A motor is coupled to the elongated cage for revolving the elongated cage about the central revolving axis. A controller is connected to the motor for controlling the revolving of the elongated cage about the central revolving axis.

20 Claims, 18 Drawing Sheets

(56) References Cited

U.S. PATENT DOCUMENTS

| | | | | |
|---|---|---|---|---|
| 2,968,168 | A * | 1/1961 | Lippincott | F25C 1/04 D15/90 |
| 3,192,726 | A | 7/1965 | Newton | |
| 3,788,089 | A | 1/1974 | Graves | |
| 6,349,550 | B1 | 2/2002 | Shapiro | |
| 8,104,297 | B2 | 1/2012 | Heger et al. | |
| 8,181,471 | B2 | 5/2012 | Heger et al. | |
| 8,484,987 | B2 | 7/2013 | Ducharme et al. | |
| 8,511,106 | B2 | 8/2013 | Ducharme et al. | |
| 8,578,721 | B2 | 11/2013 | McCollough et al. | |
| 8,584,474 | B2 | 11/2013 | McCollough et al. | |
| 8,601,829 | B2 | 12/2013 | Heger et al. | |
| 8,616,018 | B2 | 12/2013 | Jeong et al. | |
| 8,776,544 | B2 | 7/2014 | McCollough et al. | |
| 8,875,536 | B2 | 11/2014 | Jeong et al. | |
| 8,950,197 | B2 | 2/2015 | Bortoletto et al. | |
| 8,973,391 | B2 | 3/2015 | Lee | |
| 8,973,392 | B2 | 3/2015 | Jeong et al. | |
| 8,978,406 | B2 | 3/2015 | Candeo | |
| 9,074,804 | B2 | 7/2015 | Yoon | |
| 9,080,799 | B2 | 7/2015 | Hong et al. | |
| 9,109,829 | B2 | 8/2015 | Lim et al. | |
| 9,976,788 | B2 | 5/2018 | Bertolini et al. | |
| 10,323,872 | B2 | 6/2019 | Bertolini et al. | |
| 2003/0046949 | A1 | 3/2003 | An | |
| 2005/0241329 | A1 | 11/2005 | Castrellon | |
| 2006/0086129 | A1* | 4/2006 | Anselmino | F25C 5/22 62/344 |
| 2009/0044559 | A1 | 2/2009 | Heger | |
| 2009/0113918 | A1 | 5/2009 | Heger | |
| 2009/0193824 | A1 | 8/2009 | Heger | |
| 2009/0272141 | A1 | 11/2009 | Heger | |
| 2009/0277191 | A1 | 11/2009 | Heger | |
| 2010/0011786 | A1 | 1/2010 | Shin | |
| 2010/0139295 | A1 | 6/2010 | Zuccolo | |
| 2010/0218542 | A1 | 9/2010 | McCollough | |
| 2010/0326118 | A1 | 12/2010 | Jeong et al. | |
| 2011/0000248 | A1 | 1/2011 | Jeong et al. | |
| 2011/0162404 | A1 | 7/2011 | Shin et al. | |
| 2011/0162406 | A1 | 7/2011 | Shin et al. | |
| 2011/0259036 | A1* | 10/2011 | Lim | F25D 25/025 62/340 |
| 2012/0042681 | A1 | 2/2012 | McDaniel | |
| 2012/0279240 | A1 | 11/2012 | Jeong et al. | |
| 2012/0318003 | A1 | 12/2012 | Kim | |
| 2013/0227983 | A1 | 9/2013 | Jeong et al. | |
| 2013/0263621 | A1 | 10/2013 | An et al. | |
| 2013/0264929 | A1 | 10/2013 | An et al. | |
| 2013/0298405 | A1 | 11/2013 | An et al. | |
| 2014/0165602 | A1 | 6/2014 | Whirlpool | |
| 2014/0165623 | A1* | 6/2014 | Guarino | F25C 1/24 62/340 |
| 2015/0013374 | A1 | 1/2015 | Jeong et al. | |
| 2015/0135760 | A1 | 5/2015 | Jeong et al. | |
| 2015/0323238 | A1 | 11/2015 | Lim et al. | |
| 2016/0370063 | A1 | 12/2016 | Yang | |
| 2020/0406172 | A1* | 12/2020 | Abeygunawardana | C02F 1/001 |

FOREIGN PATENT DOCUMENTS

| | | | |
|---|---|---|---|
| JP | H087015 | B2 * | 1/1996 |
| JP | 2005326035 | | 11/2005 |
| JP | 4657626 | B2 * | 3/2011 |
| JP | 2013234811 | A * | 11/2013 |

OTHER PUBLICATIONS

Translated_Tadashi (Year: 2013).*
Translated_Akira (Year: 1996).*
Translated JP2005326035 Year: 2005.
Translated JPH087015 Year: 1996.
Translated CN101922832 Year: 2012.
International Search Report for PCT/US2021/024031, dated Jul. 1, 2021, 2 pages.

* cited by examiner

REVOLVING ICE MAKER

CROSS-REFERENCE TO RELATED APPLICATIONS

This application is a continuation of U.S. application Ser. No. 16/841,015 filed on Apr. 6, 2020. This application is incorporated herein by reference.

FIELD OF THE INVENTION

This application relates generally to an ice maker for a refrigeration appliance, and more particularly, to a refrigeration appliance including a rotating ice maker.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

Such conventional refrigerators are often provided with a unit for making ice pieces, commonly referred to as "ice cubes" despite the non-cubical shape of many such ice pieces. These ice making units normally are located in the freezer compartments of the refrigerators and manufacture ice by convection, i.e., by circulating cold air over water in an ice tray to freeze the water into ice cubes. Storage bins for storing the frozen ice pieces are also often provided adjacent to the ice making units. The ice pieces can be dispensed from the storage bins through a dispensing port in the door that closes the freezer to the ambient air. The dispensing of the ice usually occurs by means of an ice delivery mechanism that extends between the storage bin and the dispensing port in the freezer compartment door.

The ice makers conventionally include an ice tray with a plurality of cavities for forming the ice cubes. Water is injected into the cavities and then frozen to form the ice cubes. Thereafter, the ice cubes are either pushed out of the ice tray or the ice tray is inverted and the ice cubes are allowed to fall out of the ice tray. The conventional ice trays usually have lots of moving parts and can produce ice cubes at a limited rate and shape.

To address the foregoing issues, the present application provides an ice maker having a revolving ice tray assembly for quickly and efficiently making ice pieces.

BRIEF SUMMARY OF THE INVENTION

In accordance with one aspect, there is provided an ice maker for freezing water into ice pieces. The ice maker includes an elongated cage having a central revolving axis about which the elongated cage revolves. The elongated cage has a first end, a second end and at least one elongated slot extending between the first end and the second end. An ice tray is configured to be received in the at least one elongated slot. The ice tray includes a plurality of cavities for receiving water to be frozen into ice pieces. A motor is coupled to the elongated cage for revolving the elongated cage about the central revolving axis. A controller is connected to the motor for controlling the revolving of the elongated cage about the central revolving axis.

In accordance with another aspect, there is provided a method for freezing water into ice pieces. The method includes steps of: positioning an ice tray at a first angular position; filling the ice tray with water; partially freezing the water in the ice tray while the ice tray is at the first angular position; revolving the ice tray about a central revolving axis to a second angular position; completely freezing the water in the ice tray to form ice pieces while the ice tray is at the second angular position; and ejecting the ice pieces from the ice tray as the ice tray revolves from the second angular position to a third angular position.

In accordance with yet another aspect, there is provided a refrigeration appliance that includes a fresh food compartment for storing food items in a refrigerated environment having a target temperature above 0° C.; a freezer compartment for storing food items in a sub-freezing environment having a target temperature below 0° C.; a system evaporator for providing a cooling effect to at least one of the fresh food compartment and the freezer compartment; and an ice maker disposed within the fresh food compartment for freezing water into ice pieces. The ice maker includes an elongated cage having a central revolving axis about which the elongated cage revolves. The elongated cage has a first end, a second end and at least one elongated slot extending between the first end and the second end. An ice tray is configured to be received in the at least one elongated slot. The ice tray includes a plurality of cavities for receiving water to be frozen into ice pieces. A motor is coupled to the elongated cage for revolving the elongated cage about the central revolving axis. A controller is connected to the motor for controlling the revolving of the elongated cage about the central revolving axis.

DESCRIPTION OF EXAMPLE EMBODIMENTS

Figure 1:
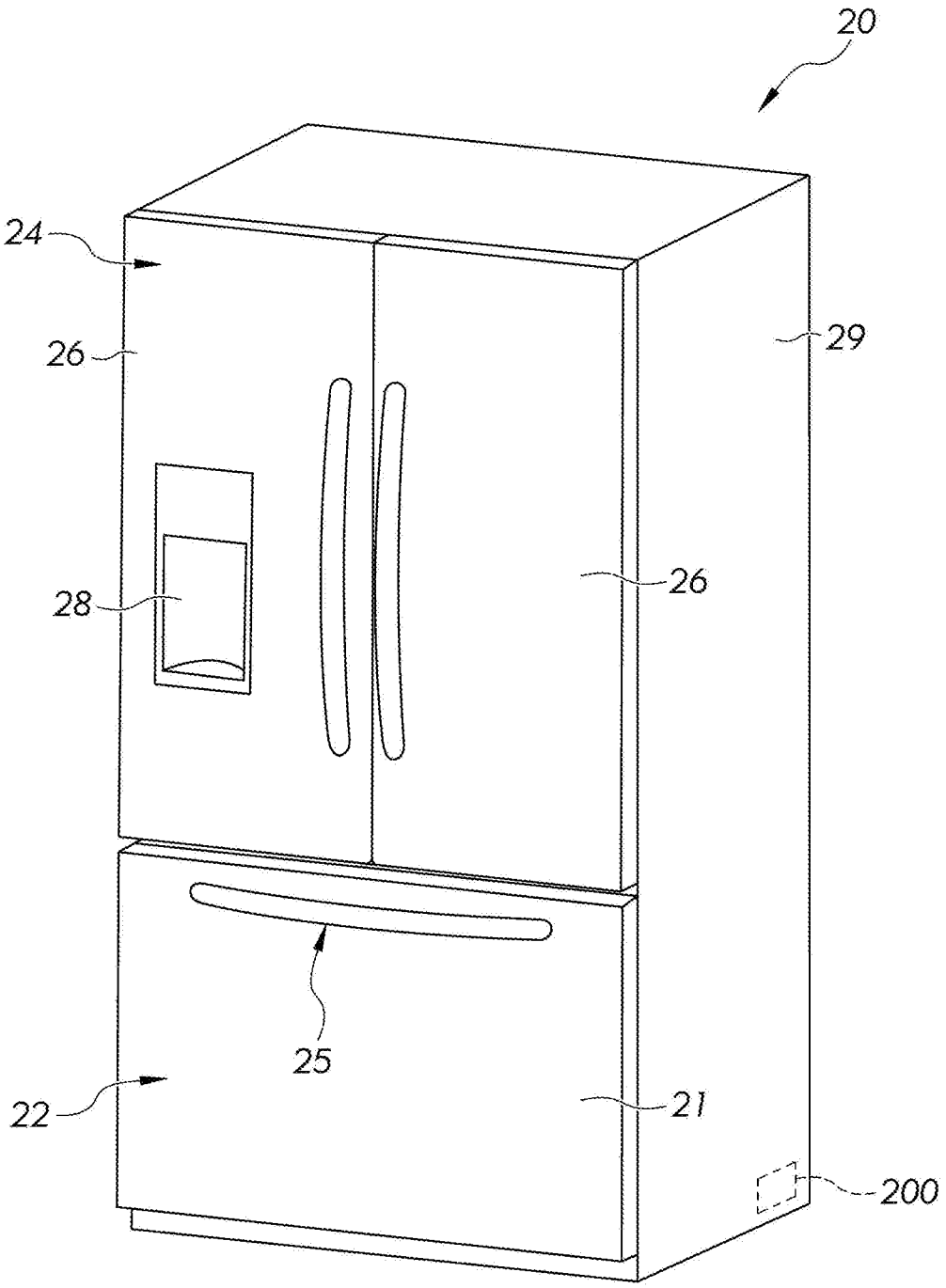
FIG. 1 is a front perspective view of a household French Door Bottom Mount showing doors of the refrigerator in a closed position.
Figure 2:
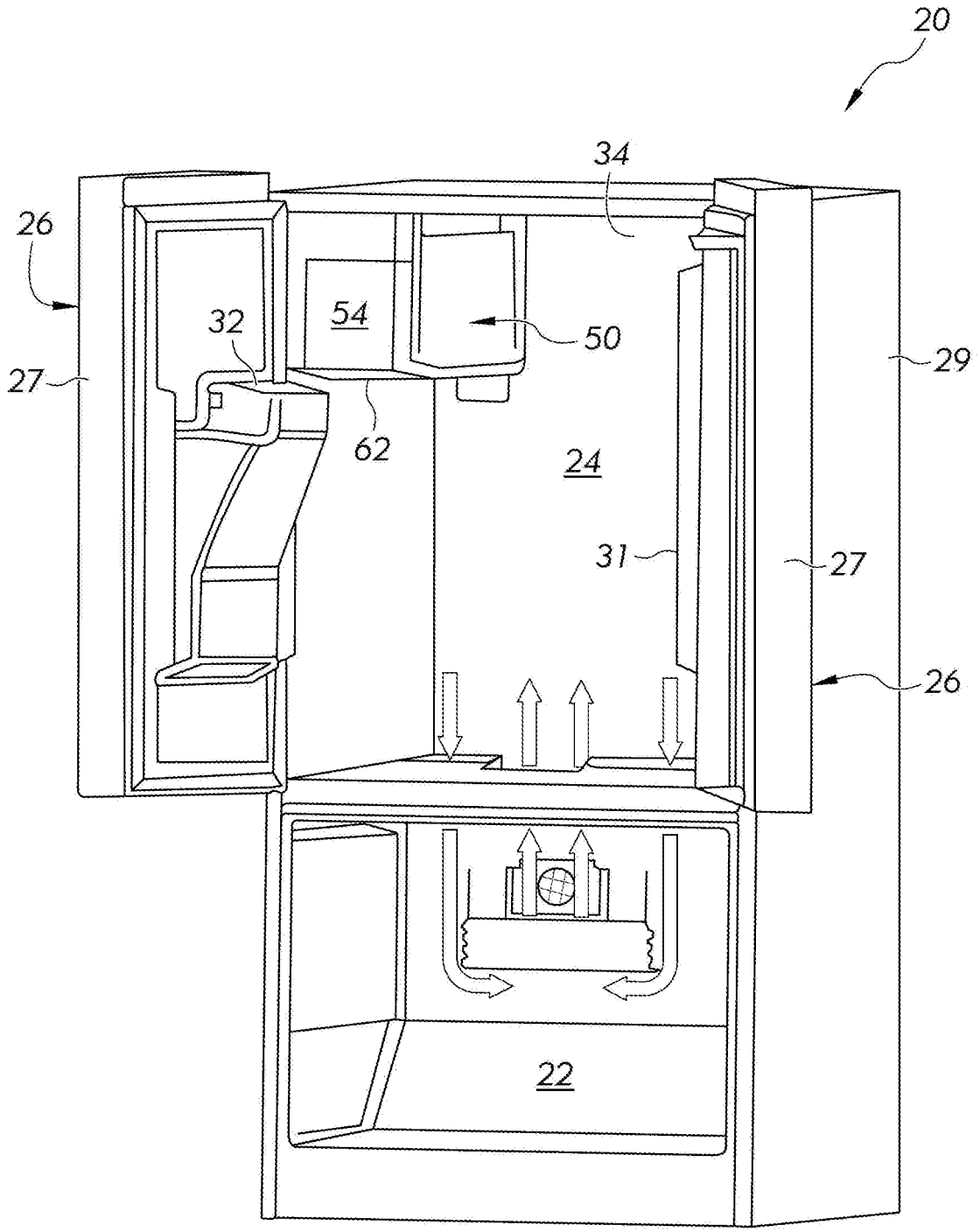
FIG. 2 is a front perspective view of the refrigerator of FIG. 1 showing the doors in an open position and an ice maker in a fresh food compartment.

Referring now to the drawings, FIG. 1 shows a refrigeration appliance in the form of a domestic refrigerator, indicated generally at 20. Although the detailed description that follows concerns a domestic refrigerator 20, the invention can be embodied by refrigeration appliances other than with a domestic refrigerator 20. Further, an embodiment is described in detail below, and shown in the figures as a bottom-mount configuration of a refrigerator 20, including a fresh food compartment 24 disposed vertically above a freezer compartment 22. However, the refrigerator 20 can have any desired configuration including at least a fresh food compartment 24 and an ice maker 50 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 26 shown in FIG. 1 are pivotally coupled to a cabinet 29 of the refrigerator 20 to restrict and grant access to the fresh food compartment 24. The door 26 can include a single door that spans the entire lateral distance across the entrance to the fresh food compartment 24, or can include a pair of French-type doors 26 as shown in FIG. 1 that collectively span the entire lateral distance of the entrance to the fresh food compartment 24 to enclose the fresh food compartment 24. For the latter configuration, a center flip mullion 31 (FIG. 2) is pivotally coupled to at least one of the doors 26 to establish a surface against which a seal provided to the other one of the doors 26 can seal the entrance to the fresh food compartment 24 at a location between opposing side surfaces 27 (FIG. 2) of the doors 26. The mullion 31 can be pivotally coupled to the door 26 to pivot between a first orientation that is substantially parallel to a planar surface of the door 26 when the door 26 is closed, and a different orientation when the door 26 is opened. The externally-exposed surface of the center mullion 31 is substantially parallel to the door 26 when the center mullion 31 is in the first orientation, and forms an angle other than parallel relative to the door 26 when the center mullion 31 is in the second orientation. The seal and the externally-exposed surface of the mullion 31 cooperate approximately midway between the lateral sides of the fresh food compartment 24.

A dispenser 28 (FIG. 1) for dispensing at least ice pieces, and optionally water, can be provided on an exterior of one of the doors 26 that restricts access to the fresh food compartment 24. The dispenser 28 includes a lever, switch, proximity sensor or other device that a user can interact with to cause frozen ice pieces to be dispensed from an ice bin 54 (FIG. 2) of the ice maker 50 disposed within the fresh food compartment 24. Ice pieces from the ice bin 54 can exit the ice bin 54 through an aperture 62 and be delivered to the dispenser 28 via an ice chute 32 (FIG. 2), which extends at least partially through the door 26 between the dispenser 28 and the ice bin 54.

Referring to FIG. 1, the freezer compartment 22 is arranged vertically beneath the fresh food compartment 24. A drawer assembly (not shown) including one or more freezer baskets (not shown) can be withdrawn from the freezer compartment 22 to grant a user access to food items stored in the freezer compartment 22. The drawer assembly can be coupled to a freezer door 21 that includes a handle 25. When a user grasps the handle 25 and pulls the freezer door 21 open, at least one or more of the freezer baskets is caused to be at least partially withdrawn from the freezer compartment 22.

The freezer compartment 22 is used to freeze and/or maintain articles of food stored in the freezer compartment 22 in a frozen condition. For this purpose, the freezer compartment 22 is in thermal communication with a freezer evaporator (not shown) that removes thermal energy from the freezer compartment 22 to maintain the temperature therein at a temperature of 0° C. or less during operation of the refrigerator 20, preferably between 0° C. and −50° C., more preferably between 0° C. and −30° C. and even more preferably between 0° C. and −20° C.

The refrigerator 20 includes an interior liner 34 (FIG. 2) that defines the fresh food compartment 24. The fresh food compartment 24 is located in the upper portion of the refrigerator 20 in this example and serves to minimize spoiling of articles of food stored therein. The fresh food compartment 24 accomplishes this by maintaining the temperature in the fresh food compartment 24 at a cool temperature that is typically above 0° C., so as not to freeze the articles of food in the fresh food compartment 24. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 24 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 24 independent of the freezer compartment 22. According to an embodiment, the temperature in the fresh food compartment 24 can be maintained at a cool temperature within a close tolerance of a range between 0° C. and 4.5° C., including any subranges and any individual temperatures falling with that range. For example, other embodiments can optionally maintain the cool temperature within the fresh food compartment 24 within a reasonably close tolerance of a temperature between 0.25° C. and 4° C.

Figure 3:
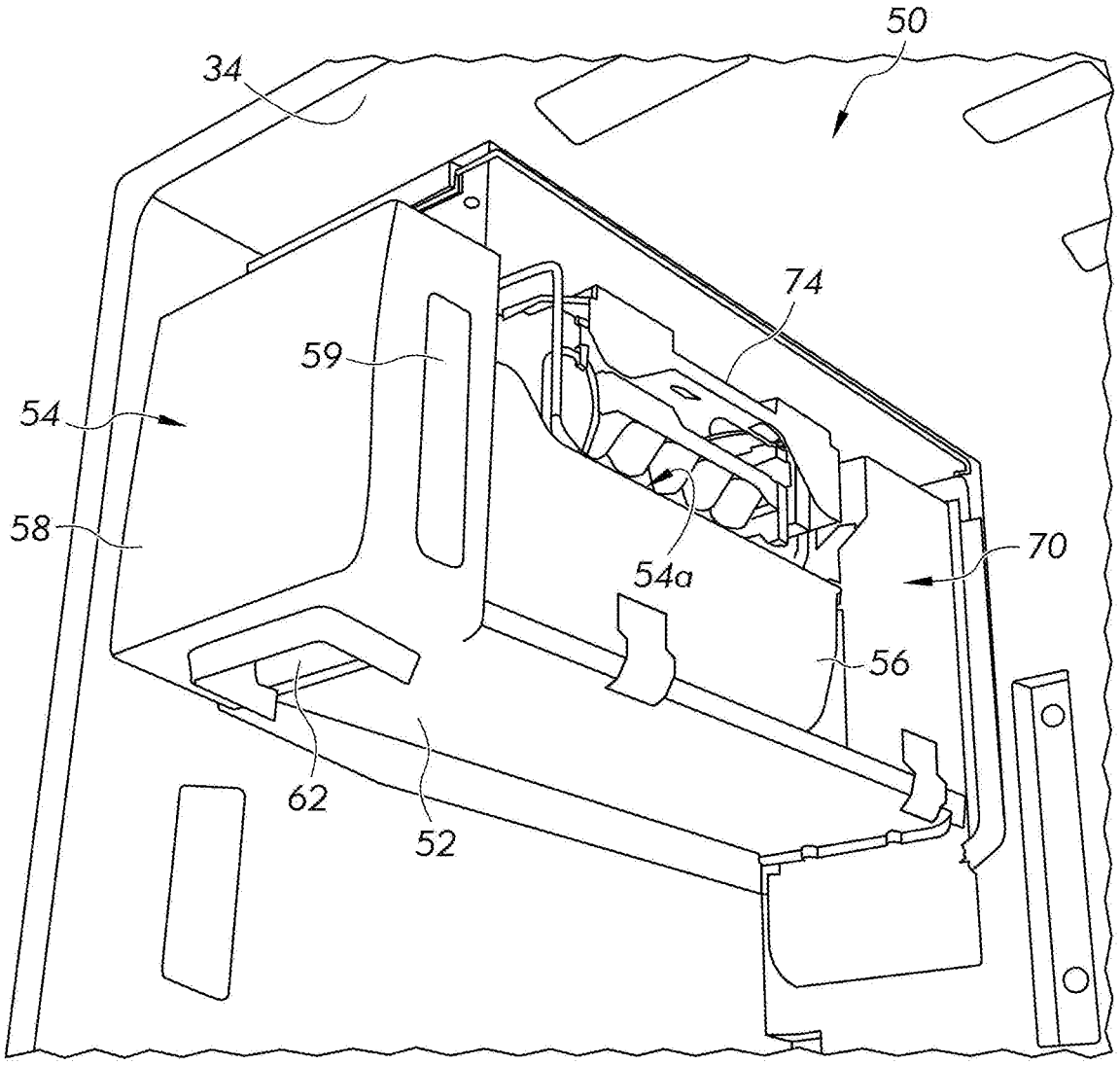
FIG. 3 (PRIOR ART)
FIG. 3 is a side perspective view of a conventional ice maker disposed in the fresh food compartment with a side wall of a frame of the ice maker removed for clarity.

A conventional ice maker 50 is shown in FIG. 3. In general, the ice maker 50 includes a frame 52, an ice bin 54, an air handler assembly 70 and a conventional ice tray assembly 74. The ice bin 54 stores ice pieces made by the ice tray assembly 74 and the air handler assembly 70 circulates cooled air to the ice tray assembly 74 and the ice bin 54. The ice maker 50 is secured within the fresh food compartment 24 using any suitable fastener. The frame 52 is generally rectangular-in-shape for receiving the ice bin 54. The frame 52 includes insulated walls for thermally isolating the ice maker 50 from the fresh food compartment 24. A plurality of fasteners (not shown) may be used for securing the frame 52 of the ice maker 50 within the fresh food compartment 24 of the refrigerator 20.

For clarity the ice maker 50 is shown with a side wall of the frame 52 removed; normally, the ice maker 50 would be enclosed by insulated walls. The ice bin 54 includes a housing 56 having an open, front end and an open top. A front cover 58 is secured to the front end of the housing 56 to enclose the front end of the housing 56. When secured together to form the ice bin 54, the housing 56 and the front cover 58 define an internal cavity 54*a* of the ice bin 54 used to store the ice pieces made by the ice tray assembly 74. The front cover 58 may be secured to the housing 56 by mechanical fasteners that can be removed using a suitable tool, examples of which include screws, nuts and bolts, or any suitable friction fitting possibly including a system of tabs allowing removal of the front cover 58 from the housing 56 by hand and without tools. Alternatively, the front cover 58 is non-removably secured in place on the housing 56 using methods such as, but not limited to, adhesives, welding, non-removable fasteners, etc. In various other examples, a recess 59 is formed in a side of the front cover 58 to define a handle that may be used by a user for ease in removing the ice bin 54 from the ice maker 50. An aperture 62 is formed in a bottom of the front cover 58. A rotatable auger (not shown) can extend along a length of the ice bin 54. As the auger rotates, ice pieces in the ice bin 54 are urged ice towards the aperture 62 wherein an ice crusher (not shown) is disposed. The ice crusher is provided for crushing the ice pieces conveyed thereto, when a user requests crushed ice. The augur can optionally be automatically activated and rotated by an auger motor assembly (not shown) of the air handler assembly 70. The aperture 62 is aligned with the ice chute 32 (FIG. 2) when the door 26 is closed. This alignment allows for the auger to push the frozen ice pieces stored in the ice bin 54 into the ice chute 32 to be dispensed by the dispenser 28.

Referring to FIGS. 4-13, an ice tray assembly 100, according to one embodiment, is illustrated. The ice tray assembly 100, in general, includes a frame 102, a motor/gearbox assembly 112, an ice tray cage 132 and ice trays 140A, 140B, 140C. The ice tray assembly 100 would replace the ice tray assembly 74 of the conventional ice maker 50 is shown in FIG. 3.

Figure 4:
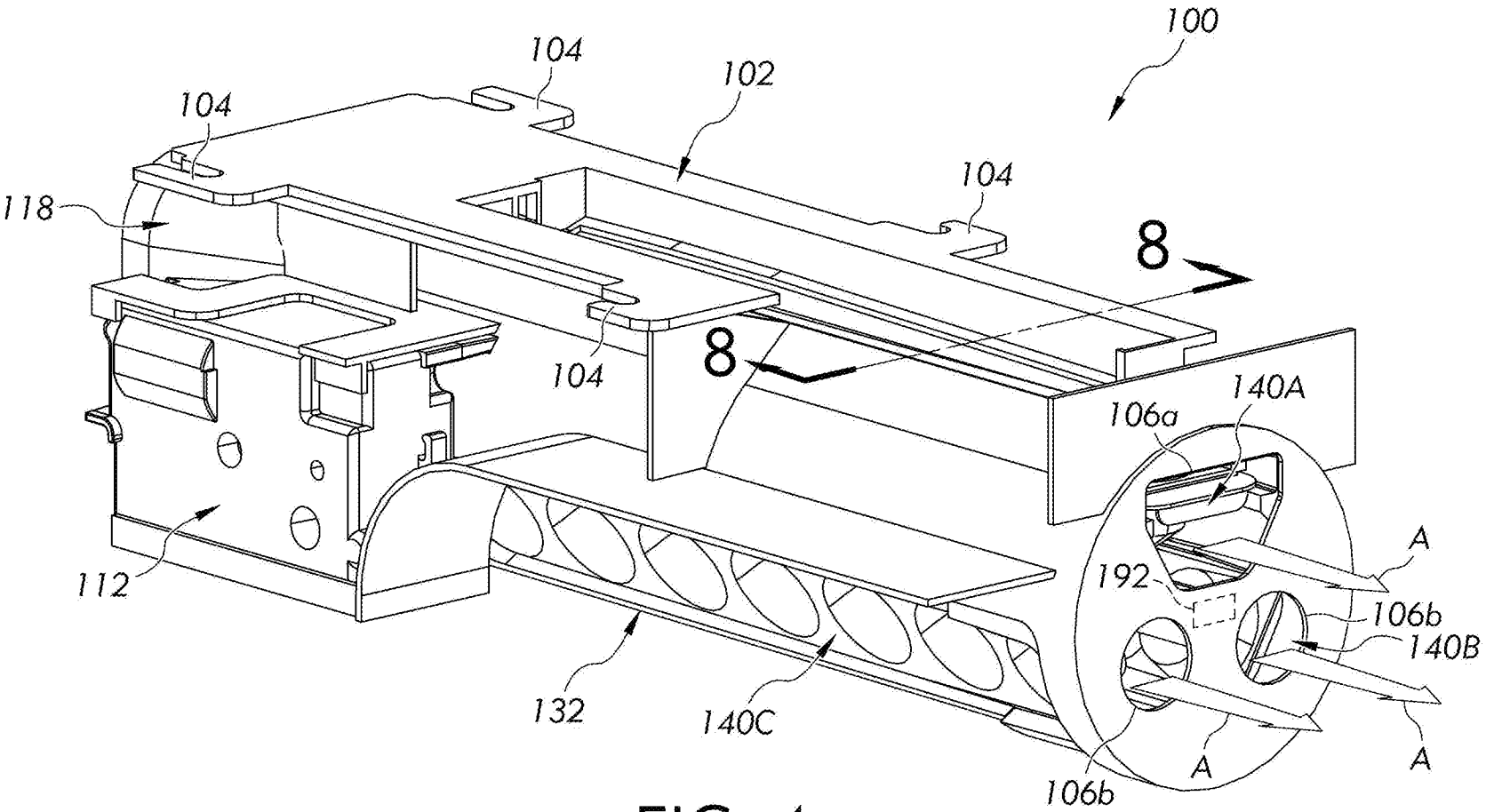
FIG. 4 is a front perspective view of an ice maker having a revolving ice tray assembly according to one embodiment of the present invention.

Referring to FIG. 4, the frame 102 is provided for securing the ice tray assembly 100 to a respective compartment, e.g., to an upper wall of the freezer compartment 22 or the fresh food compartment 24. Optionally, the ice tray assembly 100 could be mounted within a modified compartment or frame 52 as shown in FIG. 3, which could include insulated walls for thermally isolating the ice maker 50 from the fresh food compartment 24. In the embodiment shown, the frame 102 of the ice tray assembly 100 includes a plurality of mounting tabs 104 dimensioned and positioned to align with mounting holes (not shown) in the upper wall of the respective compartment. The mounting tabs 104 may be dimensioned to allow fasteners (not shown) to secure the frame 102 to the respective compartment. The frame 102 is contoured to provide mounting locations, e.g., a pocket or slot dimensioned to receive the motor/gearbox assembly 112 and an air duct 118. A plurality of openings 106*a*, 106*b* are formed in an end of the frame 102. In the embodiment shown, the opening 106*a* is configured and dimensioned to allow an ice tray 140A, 140B, 140C to pass therethrough, as described in detail below, and the openings 106*b* are circular-in-shape.

Figure 5:
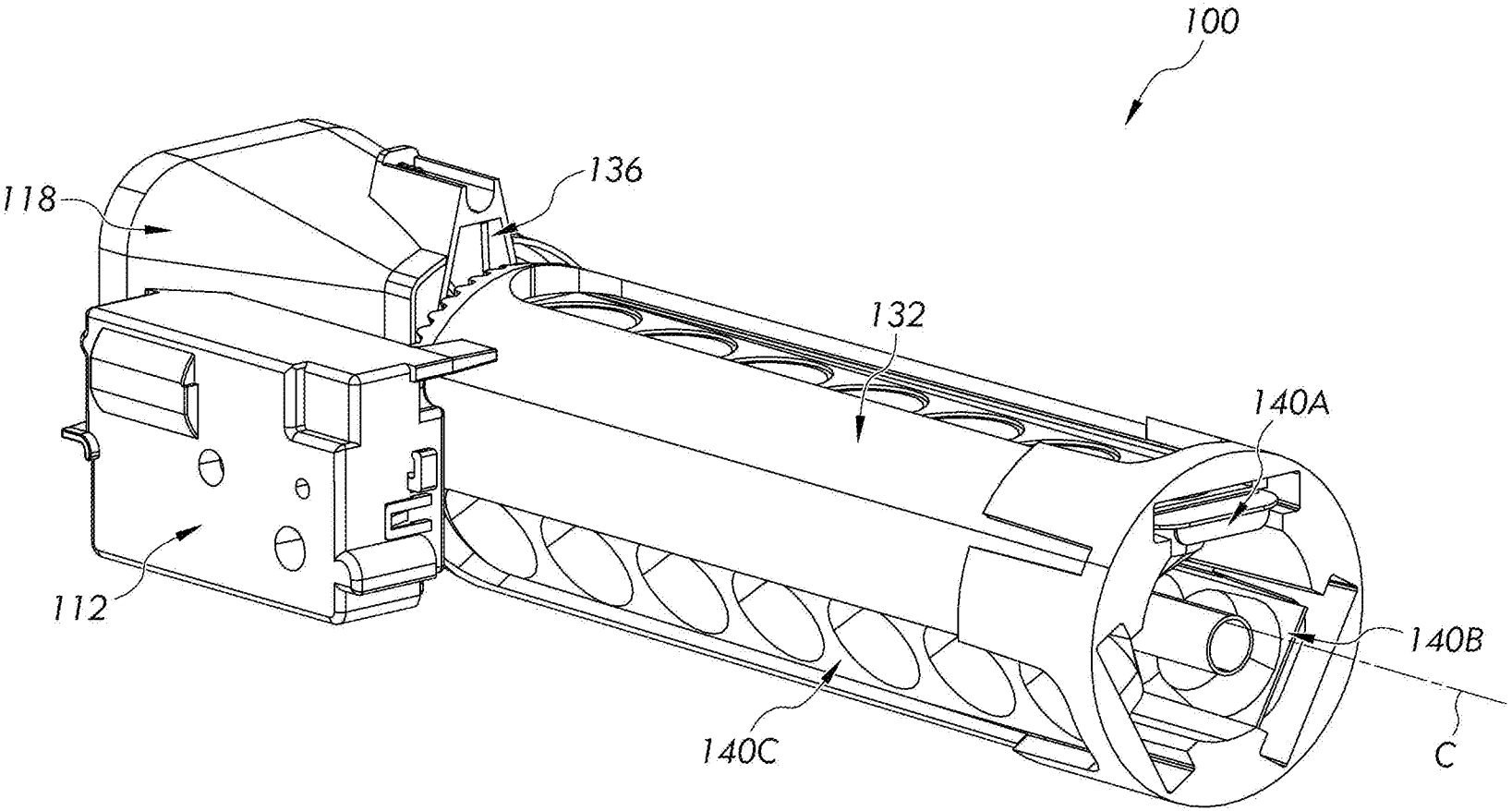
FIG. 5 is a front perspective view of the ice maker of FIG. 4 with a frame of the ice maker removed.
Figure 7:
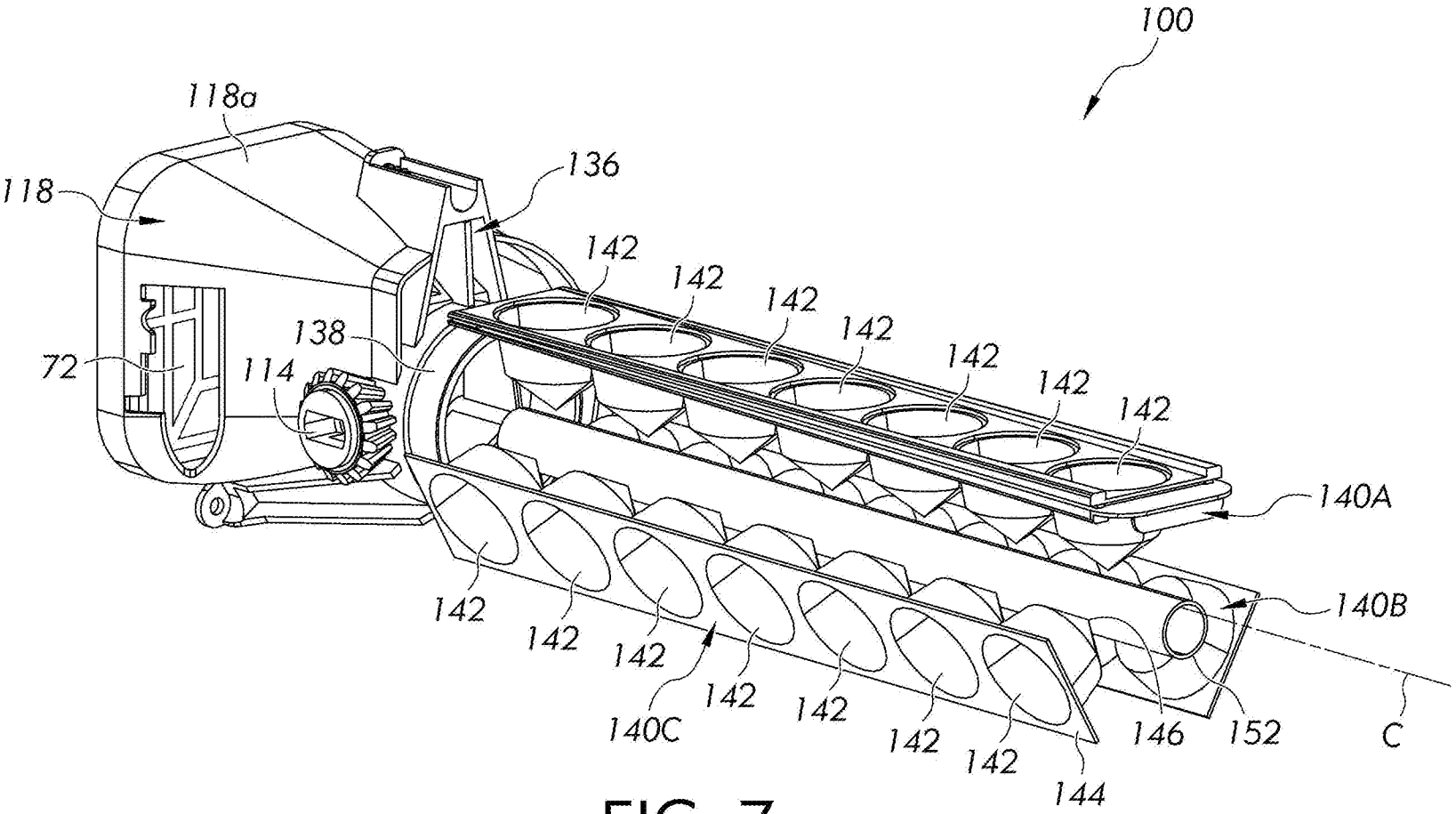
FIG. 7 is a front perspective view of the ice maker of FIG. 6 with an ice tray cage of the ice maker removed.

Referring to FIG. 5, wherein the frame 102 is removed for clarity, the motor/gearbox assembly 112 is shown positioned adjacent the air duct 118 and the ice tray cage 132. The motor/gearbox assembly 112 includes a motor (not shown) that is connected to a controller 200 (FIG. 1) of the ice maker 50. The motor, in turn, drives a gearbox assembly (gears not shown) for revolving the ice tray cage 132 about a central revolving axis C It is contemplated that the central revolving axis C may be defined by a frame member 136. Referring to FIG. 7, wherein the ice tray cage 132 is removed for clarity, the frame member 136 includes a hub 138 that is dimensioned to engage the ice tray cage 132. The hub 138 is configured to constrain the ice tray cage 132 to revolve about the central revolving axis C when the motor of the motor/gearbox assembly 112 is energized.

Referring back to FIG. 6, the motor/gearbox assembly 112 is removed to show a transmission gear 114. The transmission gear 114 is provided to couple the motor/gearbox assembly 112 to the ice tray cage 132. The motor/gearbox assembly 112, the transmission gear 114 and the ice tray cage 132 each includes a plurality of gear teeth that are dimensioned to mesh together such that rotation of the motor (not shown) of the motor/gearbox assembly 112 rotates the transmission gear 114 which, in turn, causes the ice tray cage 132 to revolve around the central revolving axis C, as described in detail below. In one example, a plurality of gear teeth 115 are located in a curved array on a terminal end of the ice tray cage 132 and extend around the outer perimeter thereof, which are positioned to be meshed together with the teeth of the transmission gear 114. In this example, the transmission gear 114 can be a bevel gear that enables the gear teeth 115 to engage with the ice tray cage 132 despite being mounted at an angle of approximately 90 degrees apart, although other angles are contemplated (i.e., the rotational axis of the transmission gear 114 is angled with respect to the central revolving axis C of the ice tray cage 132). Additionally, although a bevel gear is shown, other suitable gearing designs could be used to rotate the ice tray cage 132. In another example (not shown), the ice tray cage 132 could have an arrangement of gear teeth that extend radially outwards from the outer peripheral surface, which could engage with a suitable spur gear or the like as the transmission gear 114, or even directly to the motor/gearbox assembly 112.

Figure 6:
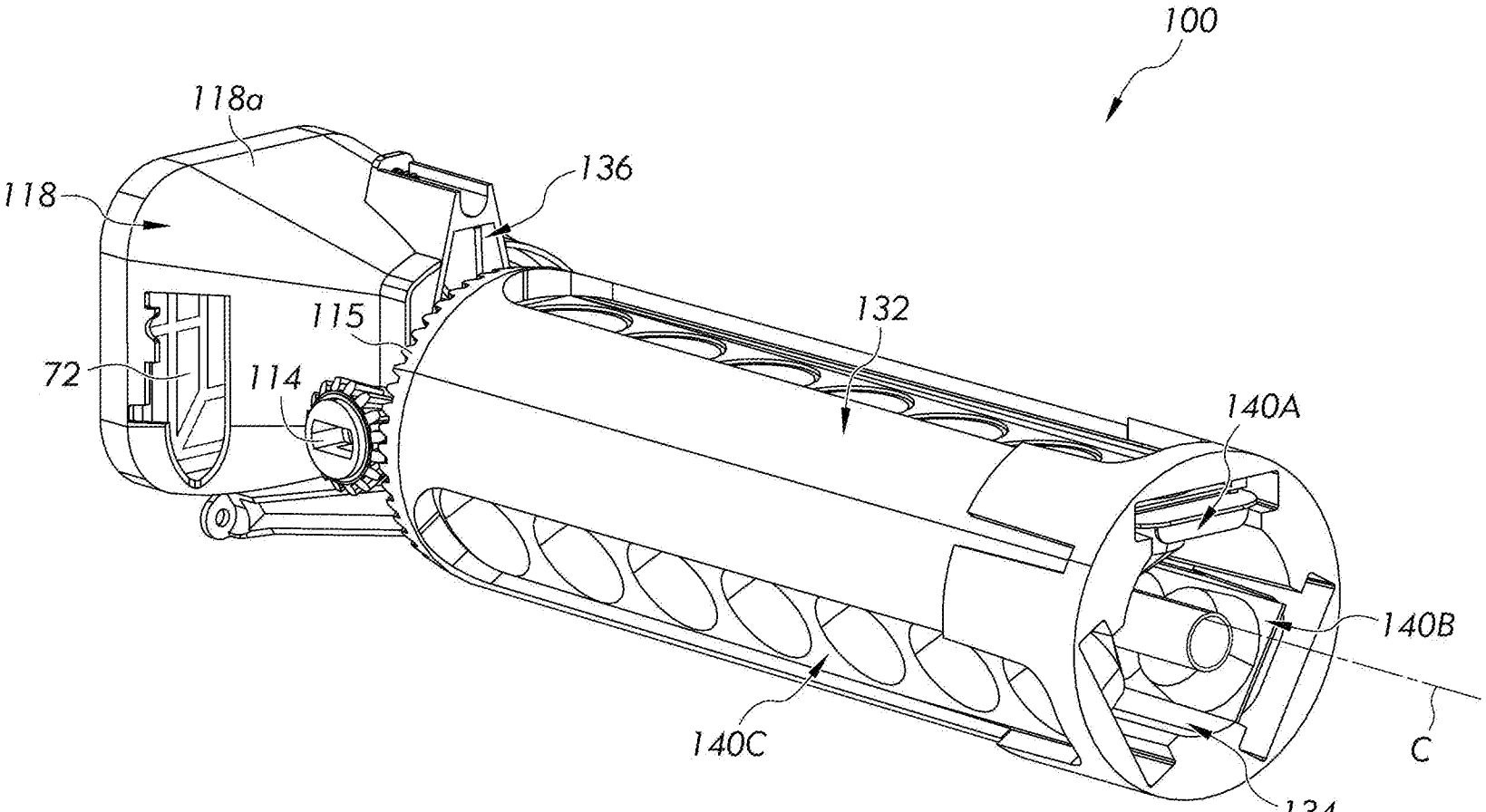
FIG. 6 is a front perspective view of the ice maker of FIG. 5 with a motor/gearbox assembly of the ice maker removed.

As shown in FIG. 6, an inlet end 118*a* of the air duct 118 is positioned in registry with a grated outlet 72 of the air handler assembly 70 (FIG. 3), or other source of cold air sufficient to freezer water into ice. The air duct 118 and the air handler assembly 70 are configured such that cold air, i.e., air that is below a freezing point of water (e.g., at a temperature of 0° C. or less, preferably between 0° C. and −50° C., more preferably between 0° C. and −30° C. and even more preferably between 0° C. and −20° C.) is conveyed from the air handler assembly 70 through the air duct 118 to the ice tray cage 132, as described in detail below. In one example, the air handler assembly 70 can include or engage with an icemaker evaporator that chills cold air for use specifically by the ice maker, or in another example, the air handler assembly 70 can be in fluid communication with another source of cold air, such as air received from a system evaporator or even cold air moving throughout a freezer compartment.

The ice tray cage 132 is configured to receive the ice trays 140A, 140B, 140C. Although three ice trays are shown and described, it is to be understood that various other numbers of ice trays could be utilized, such as four, five, six, or even more. Referring to FIG. 7, wherein the ice tray cage 132 is removed for clarity, each ice tray 140A, 140B, 140C includes a plurality of cavities 142. In the embodiment shown, each ice tray 140A, 140B, 140C includes seven (7) cavities 142, however it is contemplated that the ice trays 140A, 140B, 140C may include any number of recess. Each cavity 142 is configured to receive water that is later frozen into ice pieces, as described in detail below. Each cavity 142 has an open upper portion 144 and a lower portion 146. In the embodiment shown, the open upper portion 144 is cylindrical-in-shape and the lower portion 146 is cone-shaped. In this respect, ice pieces formed by the cavities 142 may be formed to have a similar shape. It is contemplated that the upper portion 144 and the lower portion 146 of the cavities 142 may have other shapes, as desired, e.g., spherical, cylindrical, cube, conical, pyramid or any combination of the foregoing. It is further contemplated that the ice trays could each have different shapes, so as to provide a user with a variety of ice cube shapes. It is also contemplated that the lower portion 146 may be made from a resilient material, e.g., silicone, pliable plastic or rubber material, such that the lower portion 146 may deform when a force is applied thereto to facilitate ejecting the frozen ice cubes and the return to its original shape when the force is removed.

Figure 8:
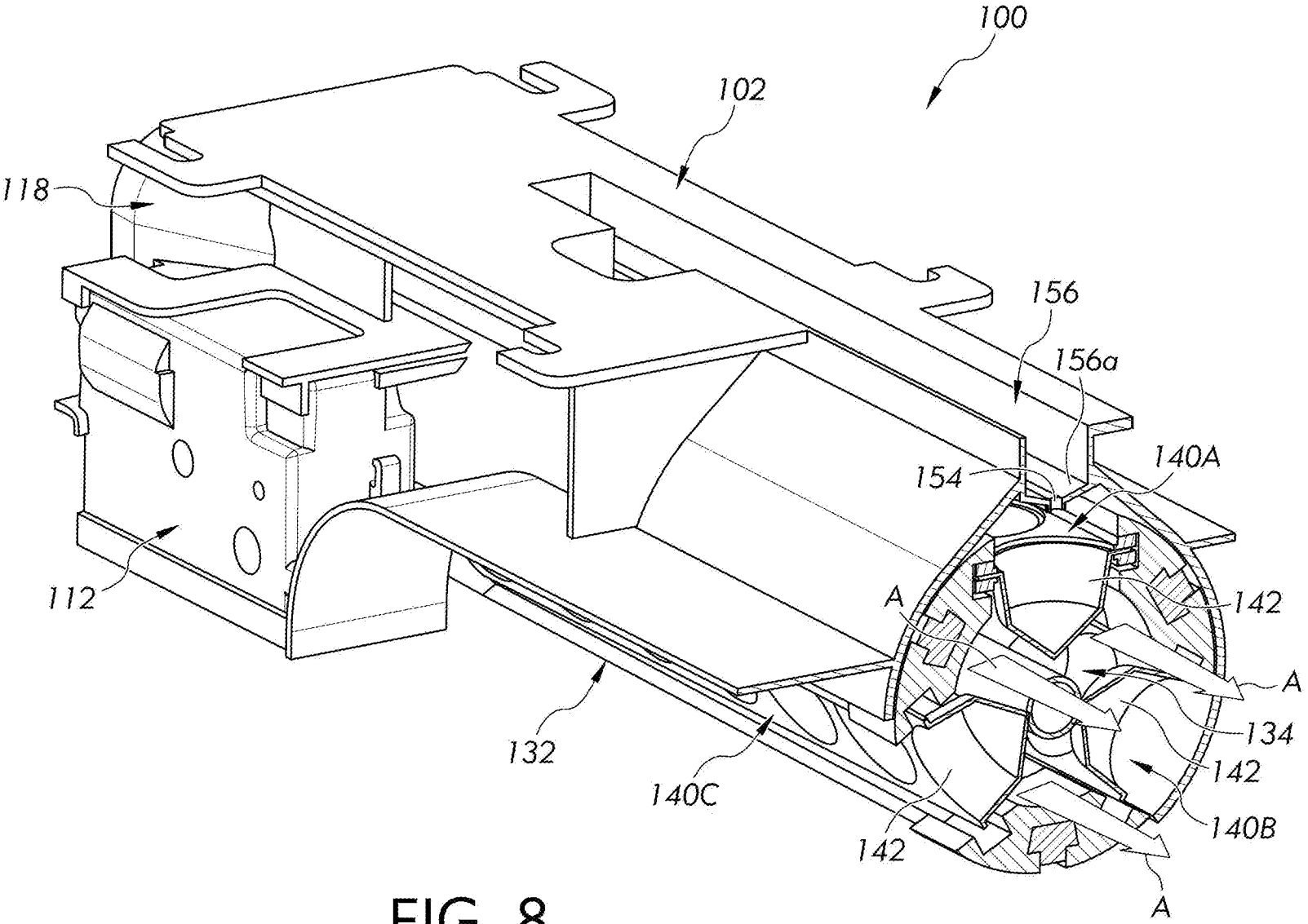
FIG. 8 is a sectioned, perspective view of the ice maker of FIG. 4 taken along section line 8-8.

The ice trays 140A, 140B, 140C are held by the ice tray cage 132 to extend longitudinally adjacent a stationary eccentric ejector bar 152. As illustrated in FIG. 6, a center of the eccentric ejector bar 152 is offset from the central revolving axis C. In particular, the ice trays 140A, 140B, 140C are positioned such that the lower portion 146 of each ice tray 140A, 140B, 140C faces the ejector bar 152. Referring to FIG. 8, the cavities 142 of the ice trays 140A, 140C, 140C extend into an inner cavity 134 of the ice tray cage 132. The inner cavity 134 defines a flow path "A" that fluidly communicates with the air duct 118, as described in detail below.

Figure 10A:
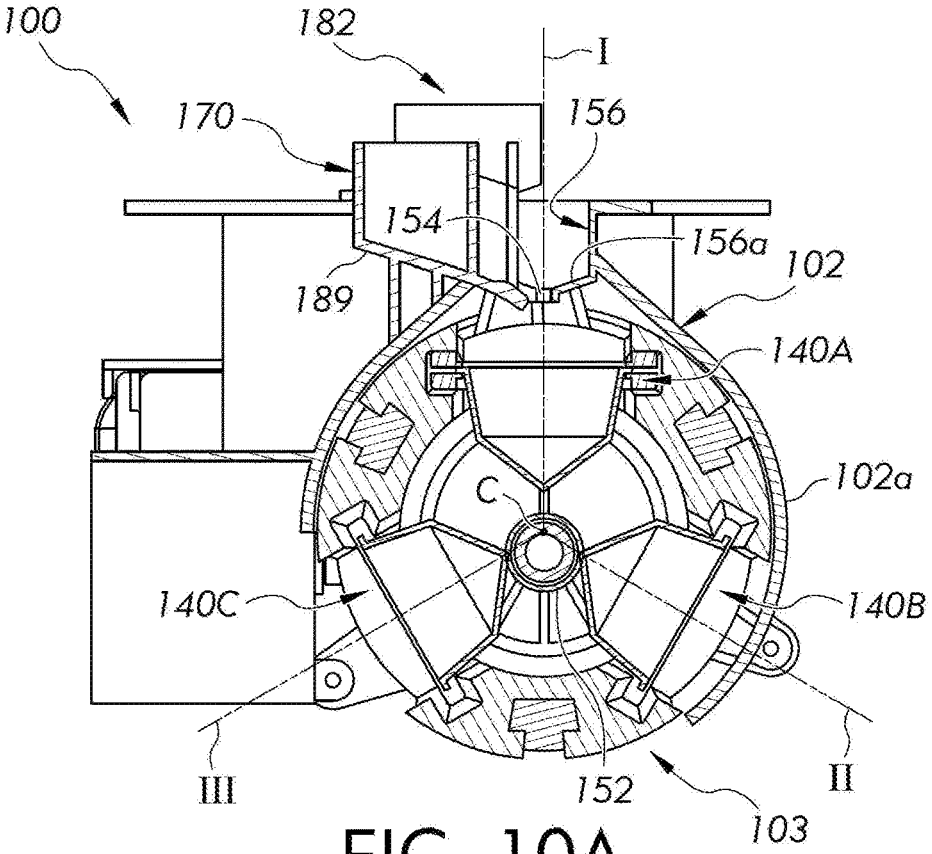
FIG. 10A is a sectioned end view of the ice maker of FIG. 9 taken along section line 10A-10A, illustrating ice trays of the ice maker in an initial condition.

Referring briefly to FIG. 10A, the ice trays 140A, 140B, 140C are illustrated such that the ice tray 140A is disposed in a first, water fill position I, the ice tray 140B is disposed in a second, freeze position II and the ice tray 140C is disposed in a third, empty position III. In the embodiment shown, the first, second and third positions I, II, III are angularly spaced around the central revolving axis C. In particular, the first, second and third positions I, II, III are illustrated as being spaced 120 degrees apart from each other. It is to be appreciated that where more ice trays are utilized, the angular spacing between them will change. For example, four trays would be spaced 90 degrees apart from each other, while five trays would be spaced 72 degrees apart from each other, etc. In such embodiments, there could be multiple freeze positions or empty positions, depending upon the arrangement of trays.

Referring back to FIG. 8, when the ice tray 140A is in the first, water fill position I, each cavity 142 of ice tray 140A is dimensioned and positioned to be located below a respective fill port 154 formed in a fill trough 156 of the frame 102. The fill trough 156 extends longitudinally along the frame 102 and is dimensioned and positioned to align with the cavities 142 of the ice tray 140A when the ice tray 140A is in the first, water fill position I. A bottom wall 156*a* of the fill trough 156 is sloped such that water flowing in the fill trough 156 drains through the discrete and independent fill ports 154 and into the respective cavities 142 of the ice tray 140A. Preferably, each fill port 154 is located generally centrally above each cavity 142 of the ice tray located at the water fill position I. In particular, the bottom wall 156*a* may be designed such that little or no residual water remains in the fill trough 156 at the end of a water fill process (i.e., the process where water is supplied to the ice maker 50 to fill the cavities 142 of the ice trays 140A, 140B, 140C). It is contemplated that a coating, e.g., a hydrophobic material, may be applied to the bottom wall 156*a* to aid in removing residual water from the fill trough 156.

Figure 9:
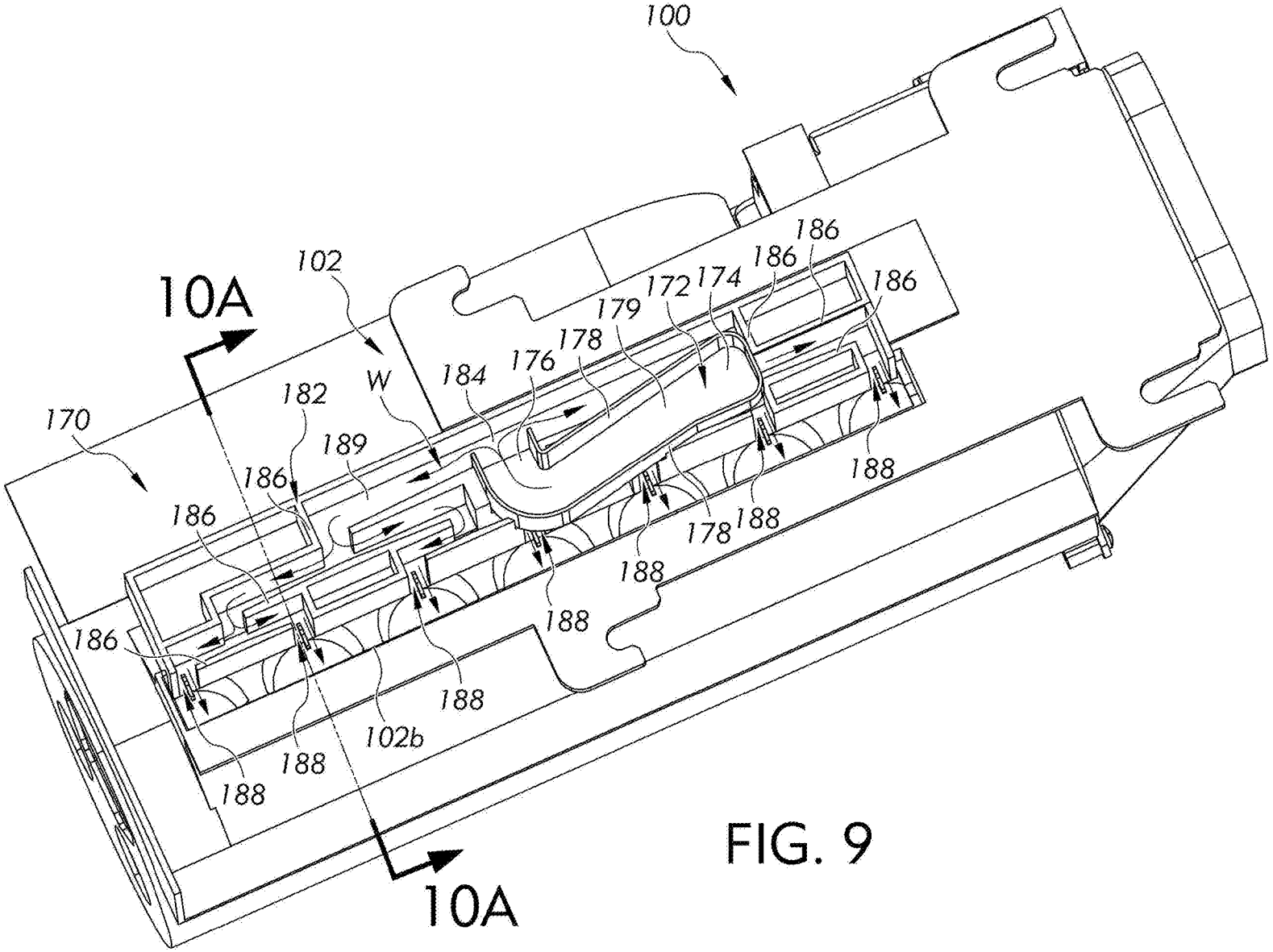
FIG. 9 is a top perspective view of the ice maker of FIG. 4 according to another embodiment wherein a water fill assembly is disposed above the ice tray cage of the ice maker.

According to another embodiment, illustrated in FIGS. 9 and 10A, a water fill assembly 170 may be attached to the frame 102 above an elongated opening 102*b* formed in a top wall of the frame 102. The water fill assembly 170, in general, includes an inlet chute 172 and a flow diverter 182. The inlet chute 172 is contoured and dimensioned to be positioned below a water fill valve (not shown) and includes a closed inlet end 174 and an open outlet end 176. Side walls 178 extend between the closed inlet end 174 and the open outlet end 176. A bottom wall 179 of the inlet chute 172 is sloped for directing the flow of water to the open outlet end 176. It is also contemplated that the entire inlet chute 172 may be tilted to direct the flow of water to the open outlet end 176. In particular, the inlet chute 172 may be designed such that little or no residual water remains in the inlet chute 172 at the end of the water fill process. It is contemplated that a coating, e.g., a hydrophobic material, may be applied to the bottom wall 179 to aid in removing residual water from the inlet chute 172. The open outlet end 176 is positioned above an inlet 184 of the flow diverter 182.

The flow diverter 182 includes a plurality of side walls 186 that are dimensioned and positioned to define a plurality of flow paths W from the inlet 184 to each of a plurality of water ports 188. Preferably, each water port 188 is located generally centrally above each cavity 142 of the ice tray located at the water fill position I. The plurality of side walls 186 are positioned to define a labyrinth or maze for equalizing the flow of water to each water port 188. It is contemplated that the flow diverter 182 may be designed such that the distance from the inlet 184 to each water port 188 is approximately equal. In this respect, the flow diverter 182 may be designed so that water flows equally to each fill port 188, and thereby to each cavity 142 of the ice tray. It is contemplated that a bottom wall 189 of the flow diverter 182 may be sloped (see FIG. 10A) or the entire flow diverter 182 may be tilted to direct the flow of water to the fill ports 188. In particular, the flow diverter 182 may be designed such that little or no residual water remains in the flow diverter 182 at the end of the water fill process. It is contemplated that a coating, e.g., a hydrophobic material, may be applied to the bottom wall 189 to aid in removing residual water from the flow diverter 182. Similar to the fill ports 154, the fill ports 188 are dimensioned and positioned to align with the cavities 142 of the ice tray 140A when the ice tray 140A is in the first, water fill position I.

Referring to FIG. 10A, the frame 102 is contoured to have an outer curved wall 102*a* that encloses or covers the open upper portions 144 of the ice tray 140A, 140B, 140C in the second, freeze position II. In this respect, ice pieces in the respective ice tray 140A, 140B, 140C are prevented from falling out of the ice tray 140A, 140B, 140C when in the second, freeze position II. The outer curved wall 102*a* can be spaced a distance from the ice tray at the second, freeze position II, or alternatively, could be immediately adjacent or even touch the ice tray or the freezing water cubes therein to prevent accidental removal from the ice tray. An opening 103 is formed in the outer curved wall 102*a* so that the open upper portion 144 of the ice tray 140A, 140B, 140C is exposed to the surrounding environment as the ice tray 140A, 140B, 140C revolves a predetermined angular range between the second, freeze position II and the third, empty position III. In the embodiment shown, the predetermined angular range is 120 degrees, although this angle may change with the number of ice trays. As described above, the ice tray cage 132 is configured to revolve the ice trays 140A, 140B, 140C in one direction R (FIGS. 11B, 12B) such that the ice trays 140A, 140B, 140C move successively from the first, water fill position I to the second, freeze position II to the third, empty position III and back to the first, water fill position I.

Referring to FIGS. 10A-12B, the ice tray assembly 100 will now be described with regard to the operation of the same. FIGS. 10A-12B illustrate the various positions that the controller 200 is programmed to cause the ice trays 140A, 140B, 140C to move through. The ice tray assembly 100 will be described with reference to three ice trays. It is contemplated that the ice tray assembly 100 may include fewer or more ice trays wherein the number of ice trays may be based on a desired production rate of the ice cubes.

Figure 10B:
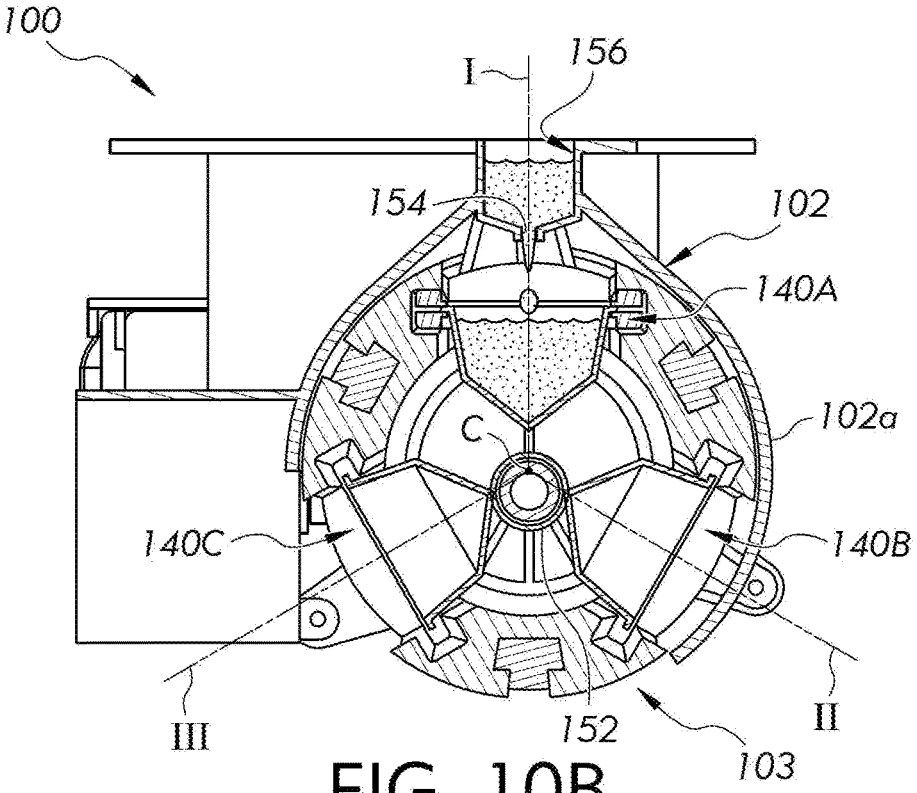
FIG. 10B is a sectioned, end view of the ice maker of FIG. 4 taken along section line 8-8, illustrating a first ice tray of the ice maker in a first, water fill position.

Referring first to FIG. 10B, the ice trays 140A, 140B, 140C are illustrated such that that ice tray 140A is in the first, water fill position I, the ice tray 140B is in the second, freeze position II and the ice tray 140C is in the third, empty position III. The operation will be described starting from an initial condition wherein all the ice trays 140A, 140B, 140C are empty (as illustrated in FIG. 10A).

The controller 200 causes the water fill valve (not shown) of the ice tray assembly 100 to move to an open position such that water fills the fill trough 156 of the frame 102. As water flows along the fill trough 156, it drains through the fill ports 154 and into the respective cavities 142 of the ice tray 140A. The controller 200 is configured such that the amount of water released into the fill trough 156 may be sufficient to fill the cavities 142 of the ice tray 140A without leaving excess water in the fill trough 156 or overfilling the cavities 142. A similar operation could be performed if the water fill assembly 170 is used.

The controller 200 is also configured to energize the air handler assembly 70 such that cold air is exhausted from the grated outlet 72 and flows into the inlet end 118*a* of the air duct 118 and along the flow path "A" of the ice try cage 132. Optionally, the air handler assembly 70 could include a fan or the like, which could be energized by the controller 200 to increase airflow along the ice trays. As the cold air passes through the flow path "A," the cold air cools the ice trays 140A, 140B, 140C. Once the cold air reaches the end of the ice tray cage 132 it exits out of the frame 102 through openings 106*a*, 106*b*, as illustrated in FIG. 4. Preferably, the location of the openings 106*a*, 106*b* correspond to the rotational positions of the ice trays 140A, 140B, 140C so that the cold airflow is encouraged to efficiently flow along the length of the ice trays, and in particular along the lower portion 146 of the cavities 142.

The controller 200 is also configured to maintain the ice tray 140A in the first, water fill position I for sufficient amount of time such that at least the water around the periphery of the cavity 142 and along the open upper portion 144 of the cavity 142 freezes to form an ice shell, as illustrated in FIG. 10A. The ice shell is formed such that the water in a central portion of each cavity 142 remains in a liquid state, but the ice shell is solid so as to inhibit any non-frozen water from leaving each cavity 142. It is contemplated that the aforementioned time may be several minutes, e.g., for an array of three trays the aforementioned time may be 20 to 30 minutes. A thermistor 192 (shown schematically in FIG. 4) may be positioned near the openings 106*a*, 106*b* for measuring the temperature of the air exiting the frame 102. The controller 200 may be configured to use the temperature measured by the thermistor 192 to control the operation of the ice tray assembly 100. For example, the controller 200 may use the measured temperature to determine the amount of time each ice tray 140A, 140B, 140C is exposed to cooling air below a predetermined temperature. Based on the combination of time and temperature, the controller 200 may be configured to determine that at least the water around the periphery of the cavity 142 and along the open upper portion 144 of the cavity 142 has frozen to form the aforementioned ice shell.

Figure 11A:
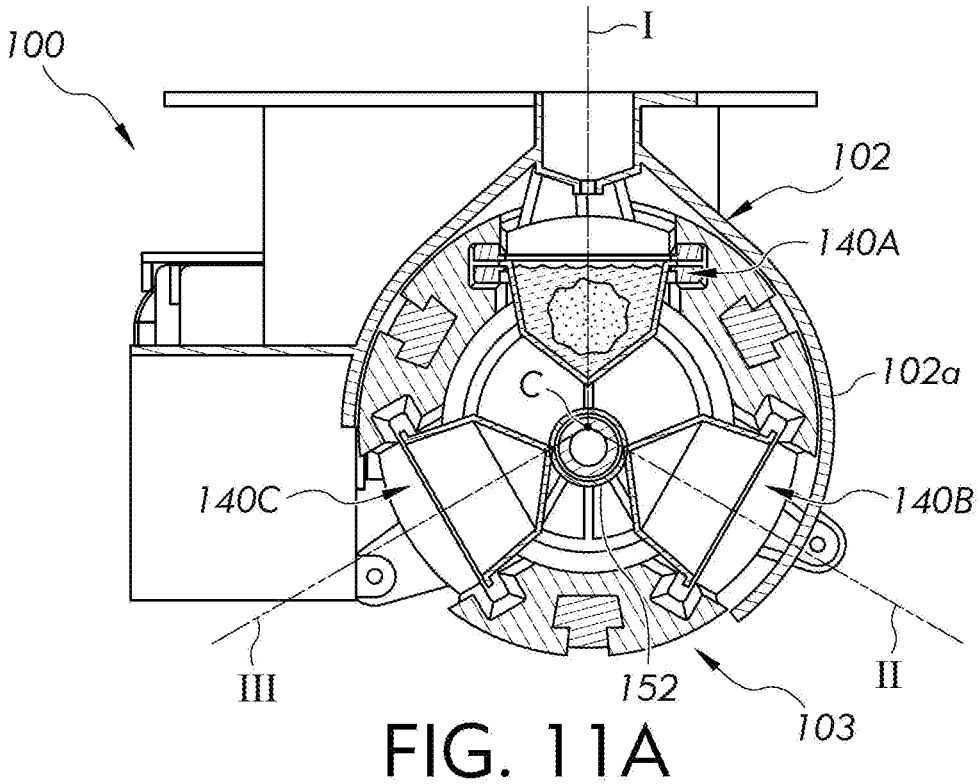
FIG. 11A is a sectioned end view of the ice maker of FIG. 10B, illustrating the first ice tray of the ice maker in the first, water fill position and an ice shell formed in the first ice tray.
Figure 11B:
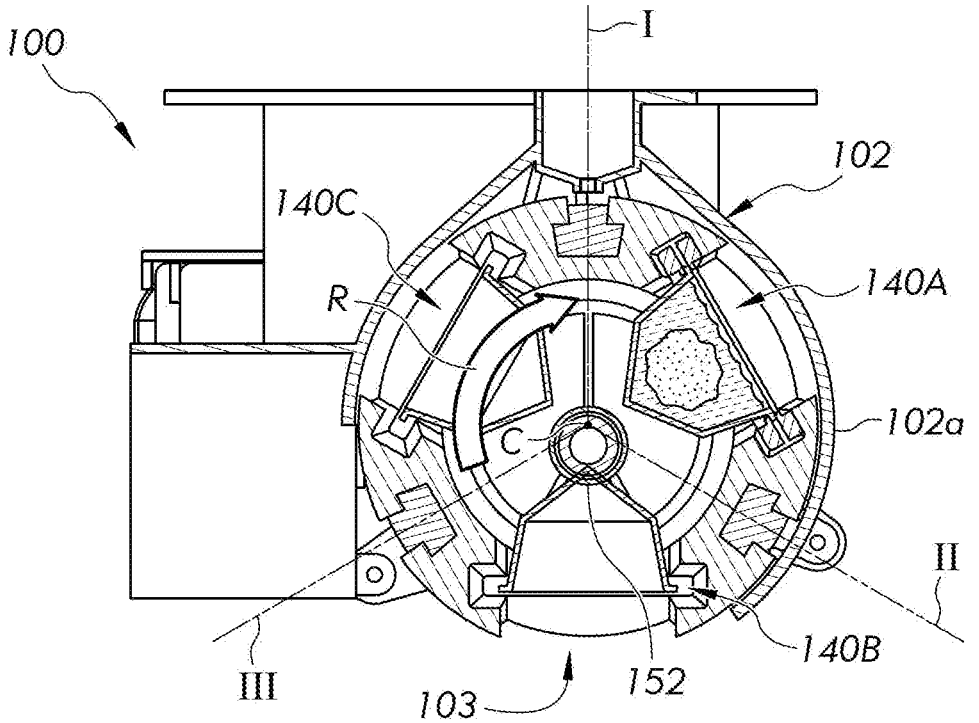
FIG. 11B is a sectioned end view of the ice maker of FIG. 10B, illustrating the first ice tray of the ice maker rotating from the first, water fill position to a second, freeze position.
Figure 11C:
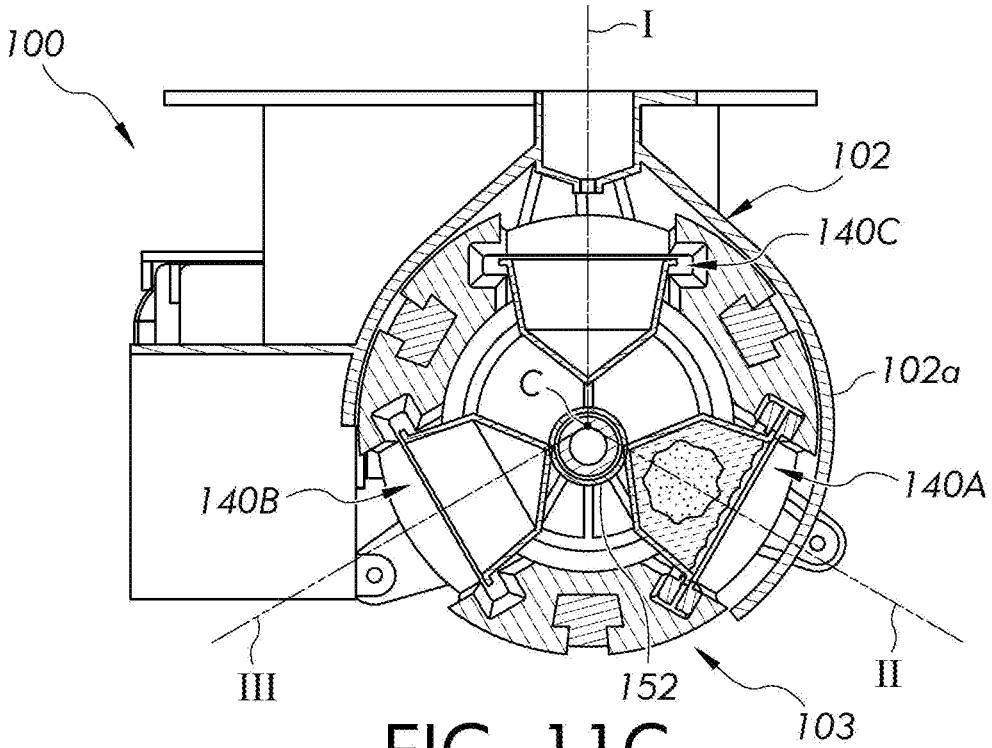
FIG. 11C is a sectioned end view of the ice maker of FIG. 10B, illustrating the first ice tray of the ice maker in the second, freeze position.
Figure 11D:
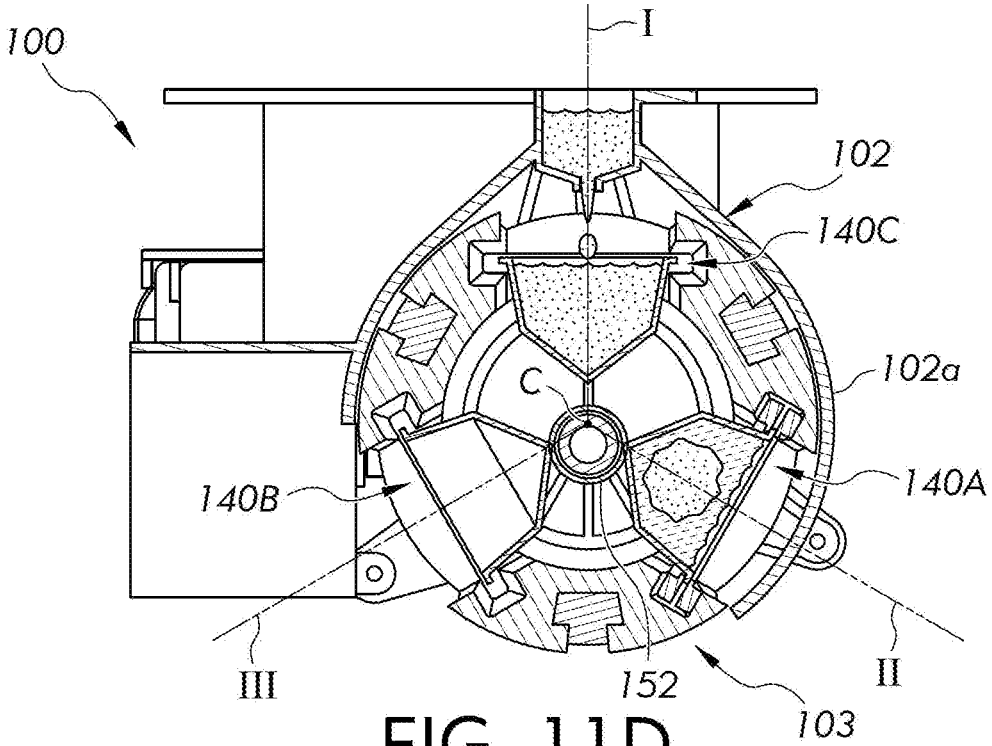
FIG. 11D is a sectioned end view of the ice maker of FIG. 10B, illustrating the first ice tray of the ice maker in the second, freeze position and a third ice tray of the ice maker in the first, water fill position.

Once the foregoing time has elapsed, the controller 200 energizes the motor/gearbox assembly 112 to rotate the ice tray cage 132 such that the ice tray 140A moves to the second, freeze position II, the ice tray 140B moves to the third, empty position II and the ice tray 140C moves to the first, water fill position I, as illustrated in FIGS. 11B and 11C. When the ice tray 140C is in the first, water fill position I, the controller 200 causes the ice tray 140C to be filled with water in the same manner described above for the ice tray 140A, see FIG. 11D.

As the ice tray 140A remains in the second, freeze position II, it continues to be exposed to the cold air flowing along flow path "A." This cold air causes the water in the cavities 142 of the ice tray 140A to freeze solidly into ice cubes. It is contemplated that the controller 200 may be programmed such that the ice tray cage 132 maintains the ice trays 140A, 140B, 140C in their respective positions until the ice shell is formed in the cavities 142 of the ice mold 140C and the water in the cavities 142 of the ice tray 140A is completely frozen (see FIG. 12A). It is contemplated that this time may be on the order of 20 to 30 minutes.

Figure 12A:
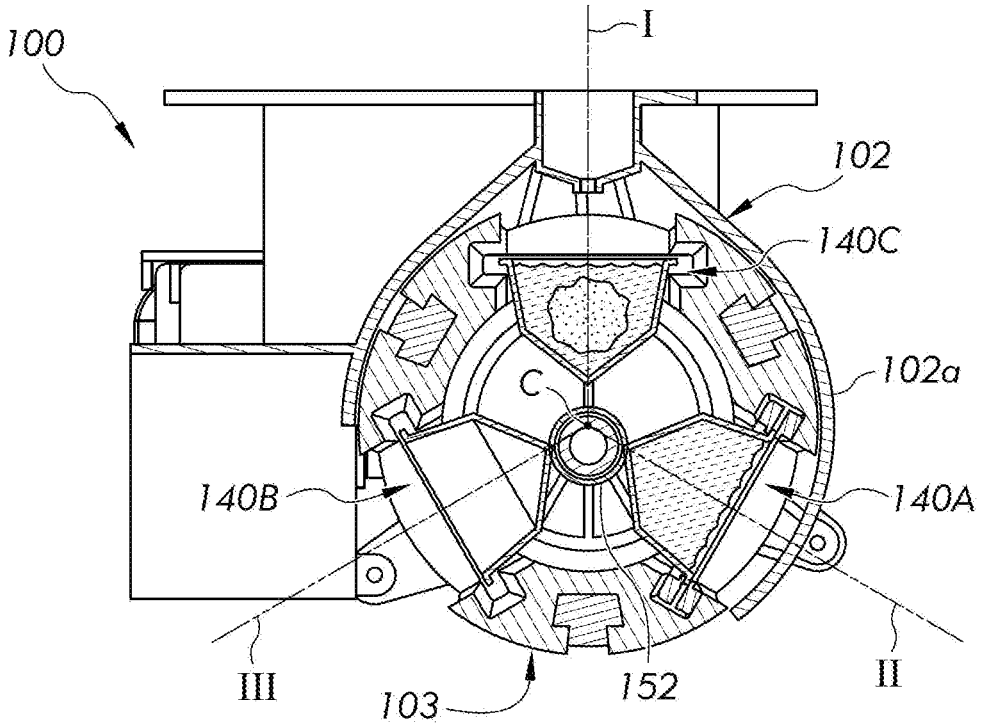
FIG. 12A is a sectioned end view of the ice maker of FIG. 10B, illustrating the first ice tray of the ice maker rotating from the second, freeze position to a third, empty position.
Figure 12B:
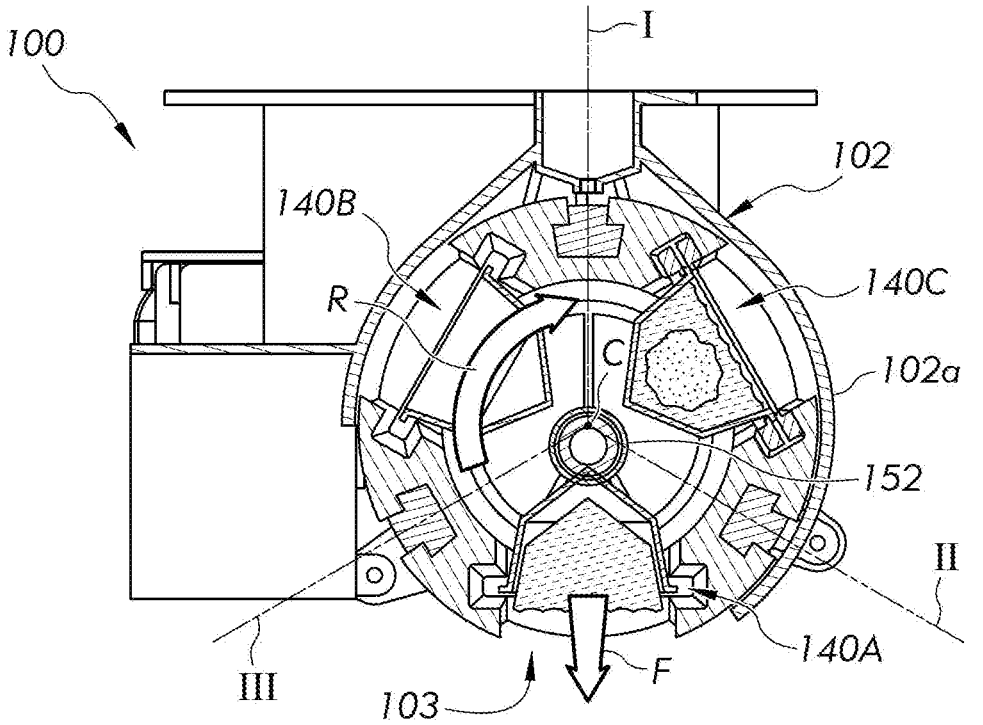
FIG. 12B is a sectioned end view of the ice maker of FIG. 10B, illustrating the first ice tray of the ice maker in the third, empty position and ice pieces ejected from the first ice tray.

Once the foregoing time has elapsed, the controller 200 causes the ice tray cage 132 to revolve such that the ice tray 140A moves to the third, empty position, the ice tray 140B moves to the first, water fill position I and the ice tray 140C moves to the second, freeze position. As the ice tray 140A moves from the second, freeze position II to the third, empty position III, the lower portion 146 of the cavities 142 contacts the outer surface of the eccentric ejector bar 152. The eccentric ejector bar 152 is positioned to be offset from the central rotational axis "C" of the ice tray assembly such that the continued rotation of the ice tray 140A causes that ejector bar 152 to contact and deform the bottom portions 146 of the cavities 142 due to the continued rotation of the ice tray cage 132. In one example, the longitudinal axis of the ejector bar 152 can be spaced a distance below the central rotational axis "C" of the ice tray assembly so that continued rotation of the ice trays will impinge upon the ejector bar 152, such as shown in FIG. 12B. It is contemplated that the ejector bar 152 may be offset in other directions relative to the central rotational axis "C" to change when during the revolving of the ice trays 140A, 140B, 140C the ice trays will impinge upon the ejector bar 152. For example, in FIG. 11C the ice tray 140A begins contacting the ejector bar 152 in the second, freeze position II and moves out of contact with the ejector bar 152 after the third, empty position III. It is contemplated that the ejector bar 152 may be offset toward the third, empty position III (i.e. to the left with respect to FIG. 11C) such that the ice tray 140A does not contact the ejector bar 152 until the ice tray 140A has revolved from the second, freeze position II. Regardless of when the ice tray 140A contacts the ejector bar 152, the deformation of the lower portion 146 of the ice tray 140A physically presses upon and applies pressure to the frozen ice pieces in the ice tray 140A which, in turn causes the ice pieces to be ejected from the ice tray 140A and out of the frame 102 through the opening 103, see FIG. 12B. The ice ejected from the ice tray 140A may then fall into the ice bin 54 (FIG. 3) located below the ice tray assembly 100.

The controller 200 is configured to repeat the foregoing steps for each ice tray 140A, 140B, 140C to create more ice cubes.

Figure 13:
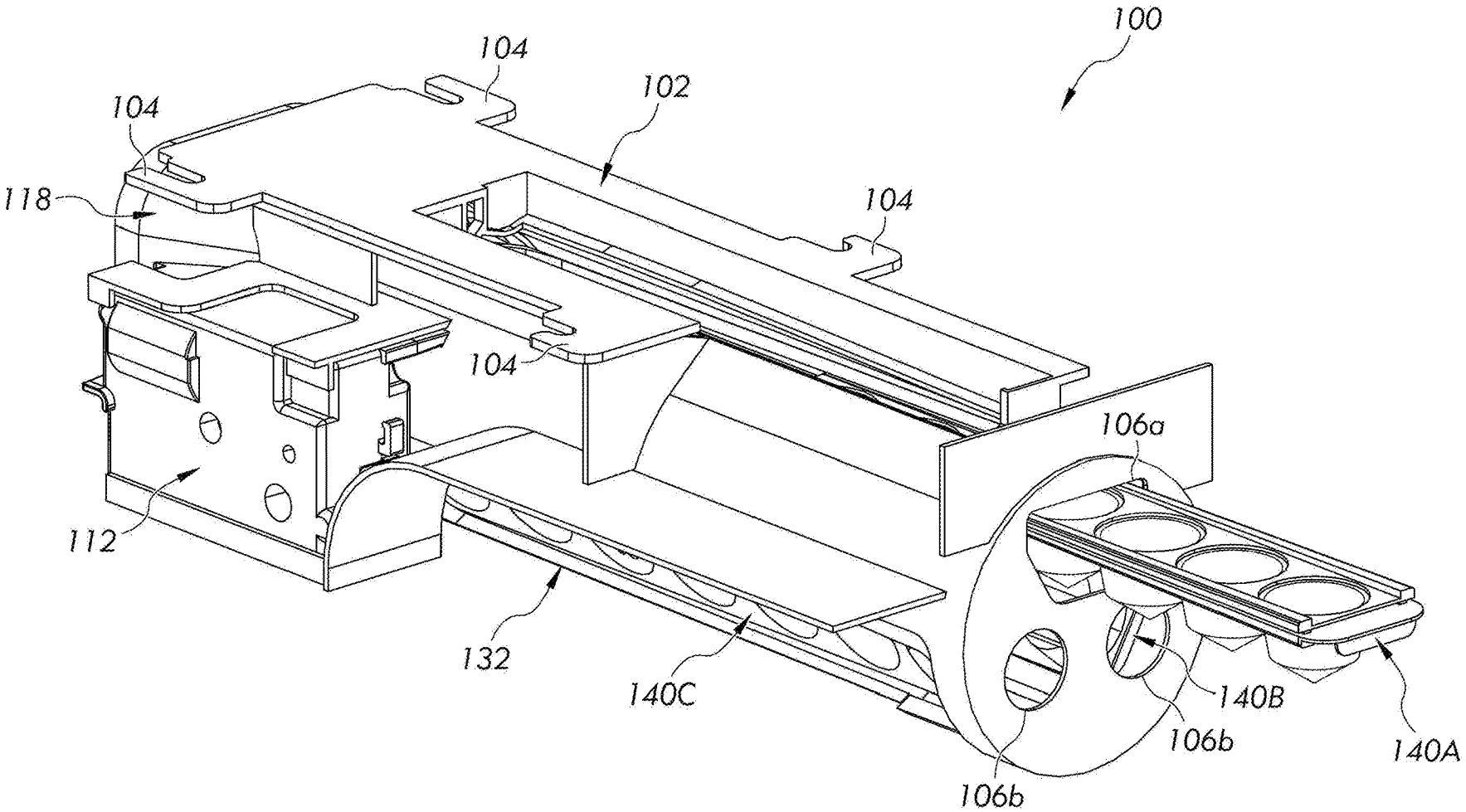
FIG. 13 a front perspective view of the ice maker of FIG. 6 with an ice tray partially removed from the ice maker.

Further, as illustrated in FIG. 13, the opening 106*a* of the frame is dimensioned to allow the ice trays 140A, 140B, 140C to be removeable from the ice tray cage 132. This allows a user the ability to insert other ice trays to provide ice pieces of various shapes and sizes, as desired. The ice trays 140A, 140B, 140C may be replaced without removing the entire ice maker 50 from the respective compartment or substantially disassembling the ice maker 50 to gain access to the ice trays 140A, 140B, 140C. The opening 106*a* also allows the user to selective exchange a desired ice tray 140A, 140B, 140C so that a mixture of ice pieces of different shapes and/or sizes may be produced by the ice maker 50.

In the embodiment shown there are three ice trays 140A, 140B, 140C that are positionable in three distinct positions wherein a first position corresponds to the position where the ice trays 140A, 140B, 140C are filled with water, a second position corresponds to the position wherein the freezing of the water in the ice trays 140A, 140B, 140C is completed and a third position corresponds to the position immediately after the frozen ice cubes have been ejected. It is contemplated that in embodiments with more than three ice trays that there may be one or more intermediate positions between the first position and the second position, the second position and the third position or the third position and the first position. Further, in the embodiment with three ice trays 140A, 140B, 140C the angles between the first, second and third positions are equal. It is contemplated that with more than three ice trays that the angle between the first, second and third positions may not be equal. For example, with four ice trays the first position may be vertical, the second position may be 90 degrees from the first position, the third position may be 90 degrees from the second position, thereby making the third position 180 degrees from the first position.

In addition, or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition, or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

Figure 14:
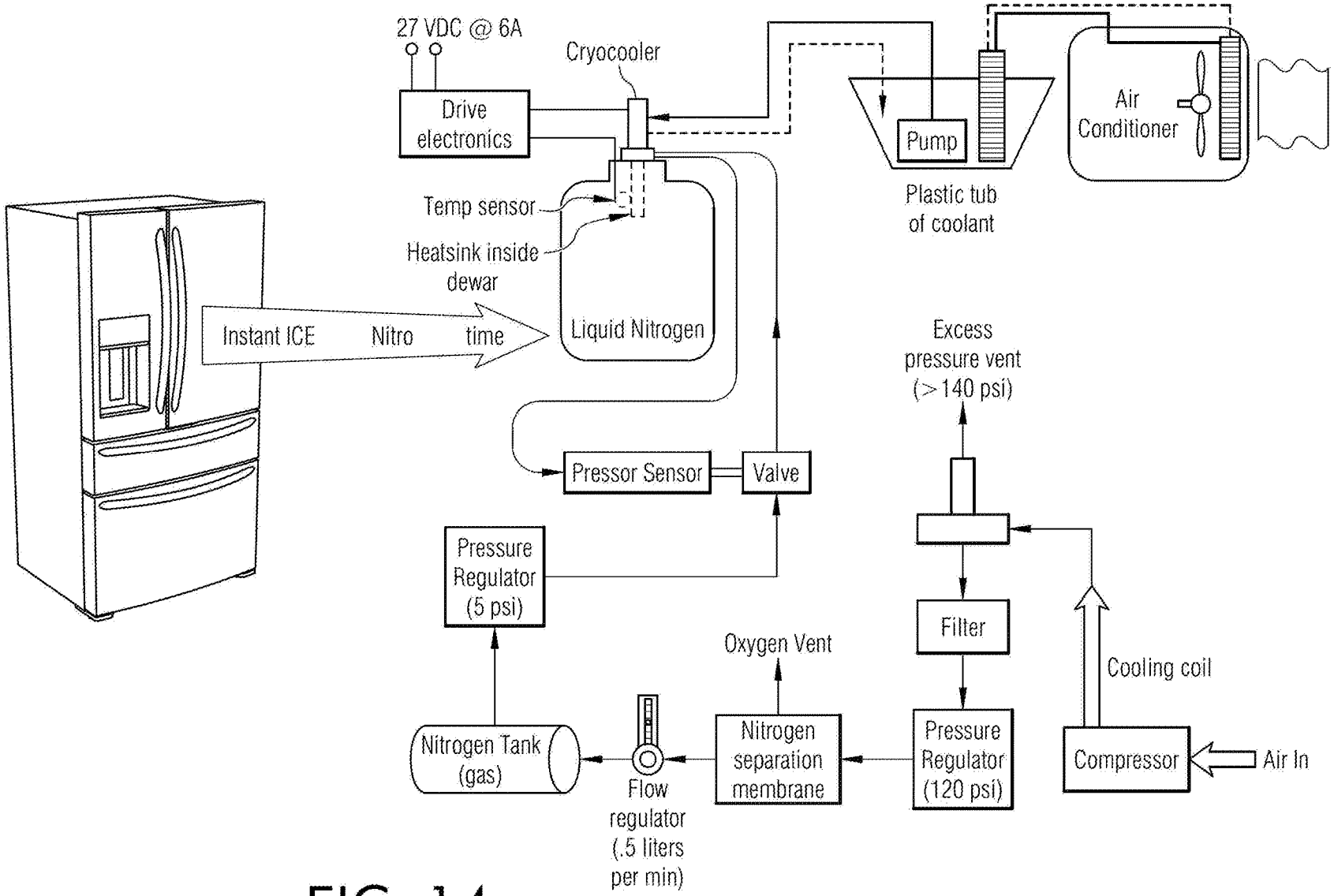
FIG. 14 is a system diagram of a quick freeze ice dispenser and ice cream maker according to another embodiment.

According to another embodiment, shown in FIG. 14, there is provided an automatic ice dispenser and ice cream dispenser that both utilize liquid nitrogen to achieve a very fast freeze time, as low as 2 seconds. This embodiment provides an ice cream dispenser next to an ice maker for instant ice cream. This embodiment also provides instant popsicles via liquid nitrogen. An example system diagram is shown in FIG. 14.

Figure 15:
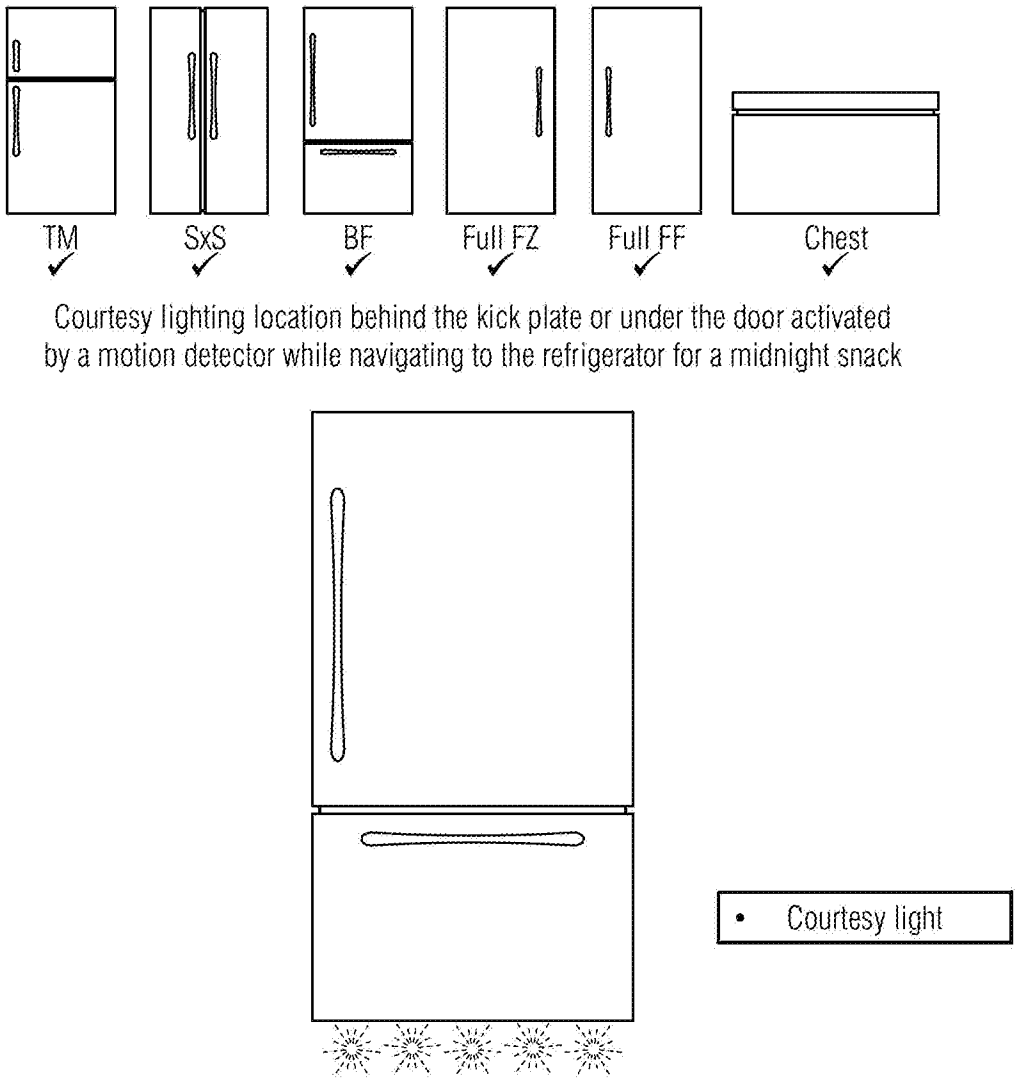
FIG. 15 is a front view of a refrigerator with a courtesy light according to another embodiment.

According to yet another embodiment, shown in FIG. 15, there is provided a courtesy light located behind a kick plate or under a door that illuminates the floor and is activated by a motion detector when a user navigates to the refrigerator for a midnight snack.

Figure 16:
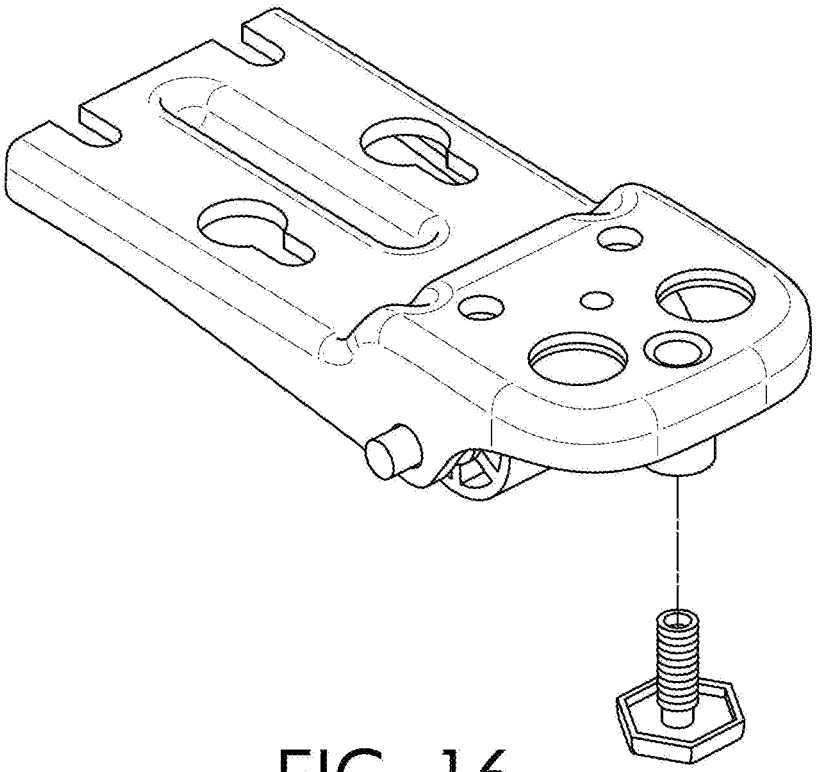
FIG. 16 is a side perspective view of an anti-tip leg assembly according to another embodiment.
Figure 17:
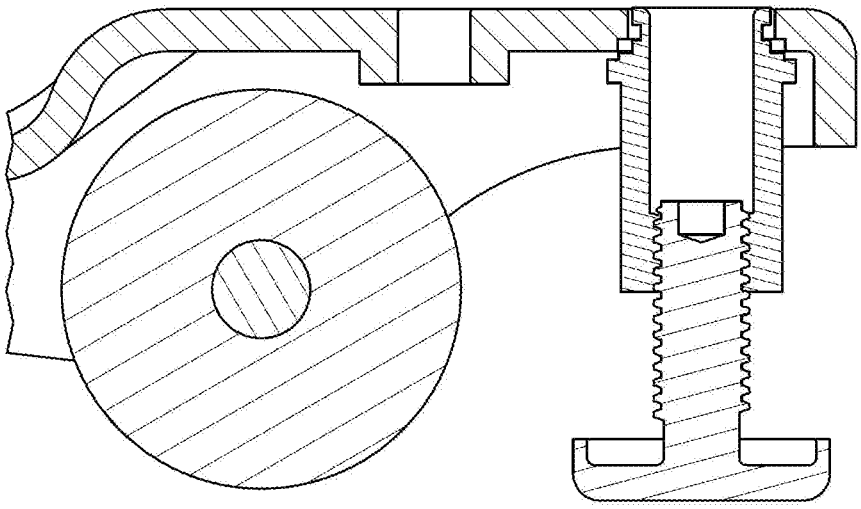
FIG. 17 is a section view of the anti-tip leg assembly of FIG. 16.

According to another embodiment, shown in FIGS. 16 and 17, an anti-tip leg is provided for a refrigerator appliance. The anti-tip leg is designed to prevent the refrigerator appliance from tipping over when the doors of the refrigerator are opened.

This embodiment provides a method for retaining the anti-tip leg in a mounting bracket. The mounting bracket is designed to be mounted to a front of a refrigerator appliance. The anti-tip leg is threaded into a hole of the mounting bracket. In particular, the hole extends through a bushing that extends downwardly from the mounting bracket. A roller is attached to a lower surface of the mounting bracket. The mounting bracket is attached to the appliance such that both the bushing and the roller are oriented to extend downwardly from the mounting bracket. Left and right pivot apertures are formed in the mounting bracket. Depending on which side the door will pivot open/close, a pivot pin (not shown) and door stopper (not shown) will be secured to either the left or the right pivot aperture.

Once the anti-tip leg is threaded into the hole, an upper end of the anti-tip leg is struck with a tool (e.g., a hammer and a center punch) such that the upper end slightly expands. The enlargement of the upper end prevents that portion of the anti-tip leg from passing through the threaded hole in the bracket. As such, the anti-tip leg cannot be easily removed from the bracket.

Figure 18:
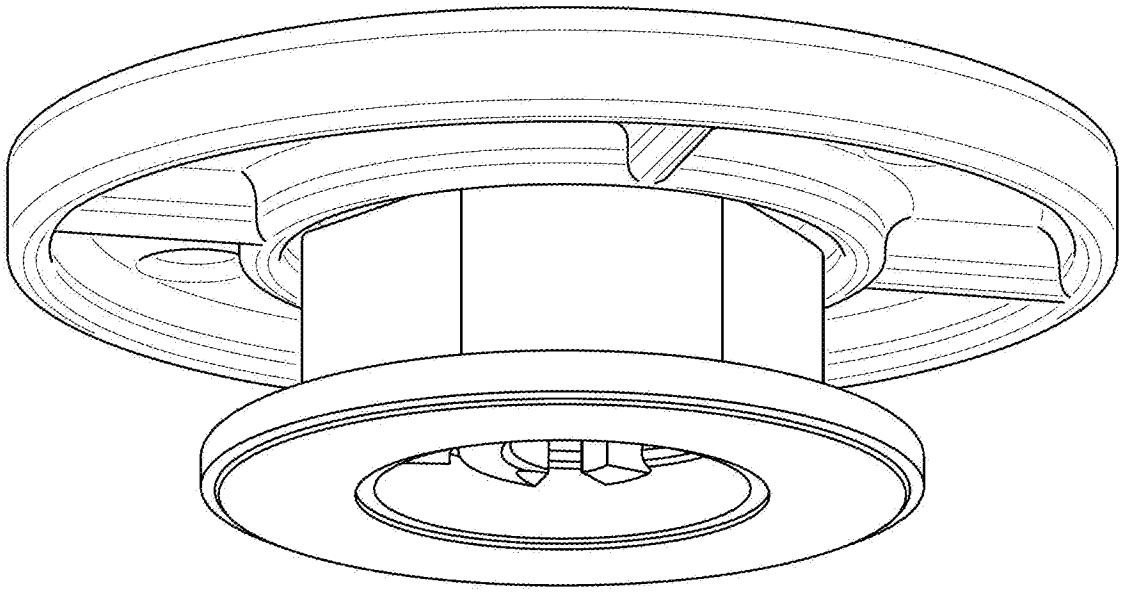
FIG. 18 is a front perspective view of an overmolded leveling leg according to another embodiment.

According to yet another embodiment, shown in FIG. 18, there is provided a leveling leg that is overmolded with a thermoplastic elastomer (TPE) (i.e., a rubbery material), particularly on the bottom of the leveling leg.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An ice maker for freezing water into ice pieces, the ice maker comprising:

an elongated cage configured to revolve about a central revolving axis, the elongated cage having a first end, a second end and a first elongated slot and a second elongated slot each extending between the first end and the second end;

a first ice tray configured to be received in the first elongated slot and a second ice tray configured to be received in the second elongated slot, the first ice tray and the second ice tray each including a plurality of cavities for receiving the water to be frozen into the ice pieces, the cavities each having a lower portion;

a motor coupled to the elongated cage for revolving the elongated cage about the central revolving axis;

a controller connected to the motor for controlling the revolving of the elongated cage about the central revolving axis; and an ejector bar extending through an inner elongated cavity of the elongated cage wherein the ejector bar is offset from the central revolving axis, wherein the lower portions of the plurality of cavities in the first ice tray or the second ice tray directly engage the ejector bar and are deformed by the ejector bar as the respective ice tray is revolved in a predetermined angular range.

2. The ice maker of claim 1, wherein the controller is configured to selectively position the first ice tray or the second ice tray in a first angular position such that each of the plurality of cavities of the respective ice tray is positioned below a respective water fill port.

3. The ice maker of claim 2, wherein each respective fill port is formed as an outlet in a bottom wall of a trough.

4. The ice maker of claim 2, further comprising a water fill assembly extending above the first ice tray or the second ice tray when the respective ice tray is in the first angular position.

5. The ice maker of claim 4, wherein the water fill assembly includes a plurality of side walls defining a labyrinth for equally flowing water to a plurality of fill ports of the water fill assembly.

6. The ice maker of claim 1, wherein during revolving of the first ice tray or the second ice tray through the predetermined angular range, the ice pieces in the respective ice tray are ejected from the respective ice tray.

7. The ice maker of claim 1, wherein the lower portions of the plurality of cavities of the first ice tray and the second ice tray are made of a resilient material.

8. The ice maker of claim 1, wherein the elongated cage includes at least three longitudinally extending slots angularly spaced around the central revolving axis of the elongated cage and each slot is configured to receive a respective ice tray.

9. The ice maker of claim 8, wherein each ice tray is independently removable from the ice maker.

10. The ice maker of claim 1, wherein the elongated cage is disposed in a frame and positioned between an outlet opening of the frame and an air duct to define an air path that extends from the air duct, through the elongated cage and to the outlet opening of the frame.

11. The ice maker of claim 10, wherein the first ice tray and the second ice tray are removable from the ice maker through the outlet opening of the frame.

12. An ice maker for freezing water into ice pieces, the ice maker comprising:

an elongated cage configured to revolve about a central revolving axis, the elongated cage having a first end, a second end and a first elongated slot and a second elongated slot each extending between the first end and the second end, the elongated cage being disposed in a frame;

a first ice tray configured to be received in the first elongated slot and a second ice tray configured to be received in the second elongated slot, the first ice tray and the second ice tray each including a plurality of cavities for receiving the water to be frozen into the ice pieces;

a motor coupled to the elongated cage for revolving the elongated cage about the central revolving axis; and a controller connected to the motor for controlling the revolving of the elongated cage about the central revolving axis, wherein the controller is configured to selectively position the first ice tray or the second ice tray in a first angular position such the respective ice tray aligns with an outlet opening in the frame for allowing the respective tray to be removable from the ice maker, wherein the central revolving axis is offset from a body of the first ice tray and a body of the second ice tray.

13. The ice maker of claim 12, wherein the elongated cage is positioned between the outlet opening of the frame and an air duct to define an air path that extends from the air duct, through the elongated cage and to the outlet opening of the frame.

14. The ice maker of claim 12, wherein the controller is configured to selectively position the first ice tray or the second ice tray in a first angular position such that each of the plurality of cavities of the respective ice tray is positioned below a respective water fill port.

15. The ice maker of claim 14, further comprising a water fill assembly extending above the first ice tray or the second ice tray when the respective ice tray is in the first angular position.

16. The ice maker of claim 12, wherein during revolving of the first ice tray or the second ice tray through a predetermined angular range, the ice pieces in the respective ice tray are ejected from the respective ice tray.

17. The ice maker of claim 16, further comprising an ejector bar extending through an inner elongated cavity of the elongated cage.

18. The ice maker of claim 17, wherein the ejector bar is offset from the central revolving axis of the elongated cage such that the plurality of cavities of the first ice tray and the second ice tray engage the ejector bar in said predetermined angular range.

19. The ice maker of claim 18, wherein a lower portion of the plurality of cavities of the first ice tray and the second ice tray is made of a resilient material, and the ice pieces are ejected from the plurality of cavities when the ejector bar contacts and deforms the lower portions of the plurality of cavities.

20. A refrigeration appliance comprising:

a fresh food compartment for storing food items in a refrigerated environment having a target temperature above 0° C.;

a freezer compartment for storing food items in a sub-freezing environment having a target temperature below 0° C.;

a system evaporator for providing a cooling effect to at least one of the fresh food compartment and the freezer compartment; and an ice maker disposed within the fresh food compartment for freezing water into ice pieces, the ice maker comprising:

an elongated cage configured to revolve about a central revolving axis, the elongated cage having a first end, a second end and a first elongated slot and a second elongated slot extending between the first end and the second end, a first ice tray configured to be received in the first elongated slot and a second ice tray configured to be received in the second elongated slot, the first ice tray and the second ice tray each including a plurality of cavities for receiving the water to be frozen into the ice pieces, a motor coupled to the elongated cage for revolving the elongated cage about the central revolving axis, a controller connected to the motor for controlling the revolving of the elongated cage about the central revolving axis, and an ejector bar extending through an inner elongated cavity of the elongated cage wherein the ejector bar is offset from the central revolving axis, wherein the plurality of cavities in the first ice tray or the second ice tray engage the ejector bar and are deformed by the ejector bar as the respective ice tray is revolved in a predetermined angular range, and wherein the central revolving axis is offset from a body of the first ice tray and a body of the second ice tray and wherein the first ice tray and the second ice tray are arranged about the central revolving axis at an angle of more than 0 degrees and less than 180 degrees from each other.

* * * * *